US011066270B2

(12) United States Patent
Shimizu et al.

(10) Patent No.: US 11,066,270 B2
(45) Date of Patent: Jul. 20, 2021

(54) SHEET FOLDING APPARATUS AND IMAGE FORMING APPARATUS

(71) Applicants: Tomohisa Shimizu, Yamanashi-ken (JP); Shogo Iwai, Yamanashi-ken (JP)

(72) Inventors: Tomohisa Shimizu, Yamanashi-ken (JP); Shogo Iwai, Yamanashi-ken (JP)

(73) Assignee: CANON FINETECH NISCA INC., Misato (JP)

( * ) Notice: Subject to any disclaimer, the term of this patent is extended or adjusted under 35 U.S.C. 154(b) by 0 days.

(21) Appl. No.: 16/707,477

(22) Filed: Dec. 9, 2019

(65) Prior Publication Data

US 2020/0180897 A1 Jun. 11, 2020

(30) Foreign Application Priority Data

Dec. 10, 2018 (JP) ..... JP2018-230528

(51) Int. Cl.

| | |
|---|---|
| ***B65H 45/16*** | (2006.01) |
| ***B65H 45/20*** | (2006.01) |
| ***B41J 11/58*** | (2006.01) |
| ***G03G 15/00*** | (2006.01) |

(52) U.S. Cl.

CPC ..... *B65H 45/16* (2013.01); *B41J 11/58* (2013.01); *B65H 45/20* (2013.01); *G03G 15/6529* (2013.01)

(58) Field of Classification Search

CPC .... B65H 45/16; B65H 45/20; G03G 15/6529; B41J 11/58

USPC ..... 270/32, 39.01

See application file for complete search history.

(56) References Cited

U.S. PATENT DOCUMENTS

| | | | | |
|---|---|---|---|---|
| 8,256,757 | B2 * | 9/2012 | Imazu | B65H 45/148 270/32 |
| 8,668,192 | B2 * | 3/2014 | Matsushita | B65H 45/18 270/58.06 |
| 9,168,762 | B2 * | 10/2015 | Nakamura | G03G 15/6529 |

FOREIGN PATENT DOCUMENTS

| | | | |
|---|---|---|---|
| JP | H05-319686 | A | 12/1993 |
| JP | 2001-171907 | A | 6/2001 |
| JP | 2002-068583 | A | 3/2002 |
| JP | 2005-067741 | A | 3/2005 |
| JP | 2008-207924 | A | 9/2008 |
| JP | 2008-247531 | A | 10/2008 |
| JP | 2012-111567 | A | 6/2012 |
| JP | 2016-182998 | A | 10/2016 |
| JP | 2016-216185 | A | 12/2016 |
| JP | 2017-128441 | A | 7/2017 |

* cited by examiner

*Primary Examiner* — Leslie A Nicholson, III
(74) *Attorney, Agent, or Firm* — Manabu Kanesaka

(57) ABSTRACT

Provided is a sheet folding apparatus for folding sheets, including: a feeding-roller pair; a loop-forming space provided downstream from the feeding-roller pair, for forming a sheet loop; a pushing member for pushing the looped sheet; a folding-roller pair for nipping a prescribed part of the sheet pushed by the pushing member, thereby to fold the sheet; and a path provided between the feeding-roller pair and the folding-roller pair, for guiding the sheet fed from the feeding-roller pair toward the loop-forming space.

13 Claims, 16 Drawing Sheets

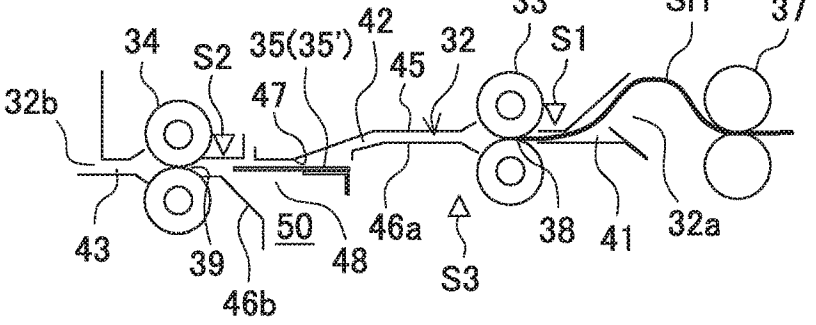
FIG. 9A
FIG. 9B
FIG. 9C
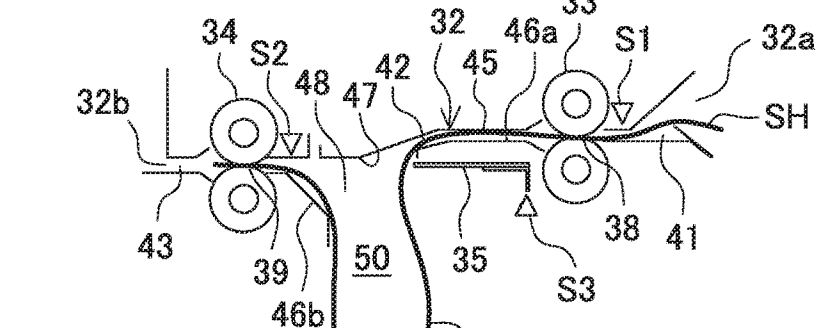
FIG. 9D
FIG. 9E
FIG. 9F

SHEET FOLDING APPARATUS AND IMAGE FORMING APPARATUS

BACKGROUND OF THE INVENTION

1. Field of the Invention

The present invention relates to a sheet folding apparatus configured to perform a sheet folding process.

2. Description of Related Arts

Hitherto, sheet folding apparatuses have been known, which are used in image forming apparatuses such as copiers and printers and which fold a sheet at a predetermined position. The sheet folding process includes folding a sheet along a center line to form two parts, folding a sheet along two lines on the same side to form three parts, and folding a sheet along two lines at opposite sides, respectively, to form a Z-held sheet.

A sheet folding apparatus is known, which comprises a sheet-feeding roller pair provided upstream of a horizontal upper guide plate, a sheet-folding roller pair provided downstream of the horizontal upper guide plate, and a sheet deflection guide member (i.e., a pushing member) provided upstream from the sheet-folding roller pair (e.g., JP 2002-068583 A). This apparatus is configured such that the sheet deflection guide member moves from a second position which is retreated obliquely downward, upstream from the sheet-folding roller pair, to a first position where the front edge of the sheet is brought to a location near the sheet take-in part of the sheet-folding roller pair, allowing a prescribed end of the sheet hanging down in a space in front of the sheet-folding roller pair to be taken into the sheet take-in part, whereby the sheet is held double or Z-folded.

Additionally, there is proposed a sheet processing apparatus which comprises a sheet-transporting roller pair provided upstream of a sheet transport path constituted by an upper guide member and a lower guide member facing each other, a sheet-folding roller pair provided downstream of the sheet transport path, and a pressing member (i.e., a pushing member) which is freely movable between a first position and a second position, the first position functioning to block a cutaway portion formed in the lower guide plate, the second position being retreated obliquely downward from the upstream side of the cutaway portion, and, with the above structure, the sheet processing apparatus also performs sheet material bending process including the double-folding and Z-folding (e.g., JP 2005-067741 A). The pressing member moves, from the second position, along the upper guide member, abutting on the sheet material hanging down from a cutaway portion opened between the sheet-feeding roller pair and the sheet-folding roller pair, to the first position, while pressing, with its front-end roller, the sheet material, and guides the bending position of the sheet material to a nip between the sheet-folding rollers, which bend the sheet material by their rotation.

In the above apparatuses disclosed in patent documents 1 and 2, in the case of Z-folding of sheet, while the sheet-folding roller pair is nipping the front edge (downstream edge in the sheet transporting direction) of the sheet and being stopped, the sheet-feeding roller pair continues transporting the sheet from upstream side to make a loop of sheet in the space opened at a lower part of the transport path. However, since the sheet is transported horizontally and linearly from the sheet-feeding roller pair toward the sheet-folding roller pair, when the sheet is made to curve into a loop shape, the transport load applied on the sheet-feeding roller pair temporarily increases due to the stiffness of the sheet. In addition, the foregoing configuration may cause the sheet to be curved toward the transport path, opposite to the space, depending on the transporting conditions.

Particularly, in the sheet-feeding roller pair, the sheet may slip due to the increase of transport load, and as a result, the sheet-folding position which the pushing member is pressed against may change and the change will not allow the sheet to be folded along an accurate folding line.

SUMMARY OF THE INVENTION

The present invention relates to a sheet folding apparatus, including: a feeding-roller pair, a loop-forming space which is provided downstream from the feeding-roller pair, for forming a sheet loop, a pushing member for pushing the sheet formed in a loop shape, a folding-roller pair for folding the sheet by nipping a prescribed part of the sheet pushed by the pushing member, and a path which is provided between the feeding-roller pair and the folding-roller pair and guides the sheet coming from the feeding-roller pair toward the direction of the loop-forming space.

BRIEF DESCRIPTION OF THE DRAWINGS

FIGS. 9A to 9F are sectional views illustrating the sheet-folding steps performed in the sheet folding apparatus;

DETAILED DESCRIPTION OF THE PREFERRED EMBODIMENTS

A preferred embodiment of this invention will be described, with reference to the accompanying drawings.

[Image Forming System]

Figure 1:
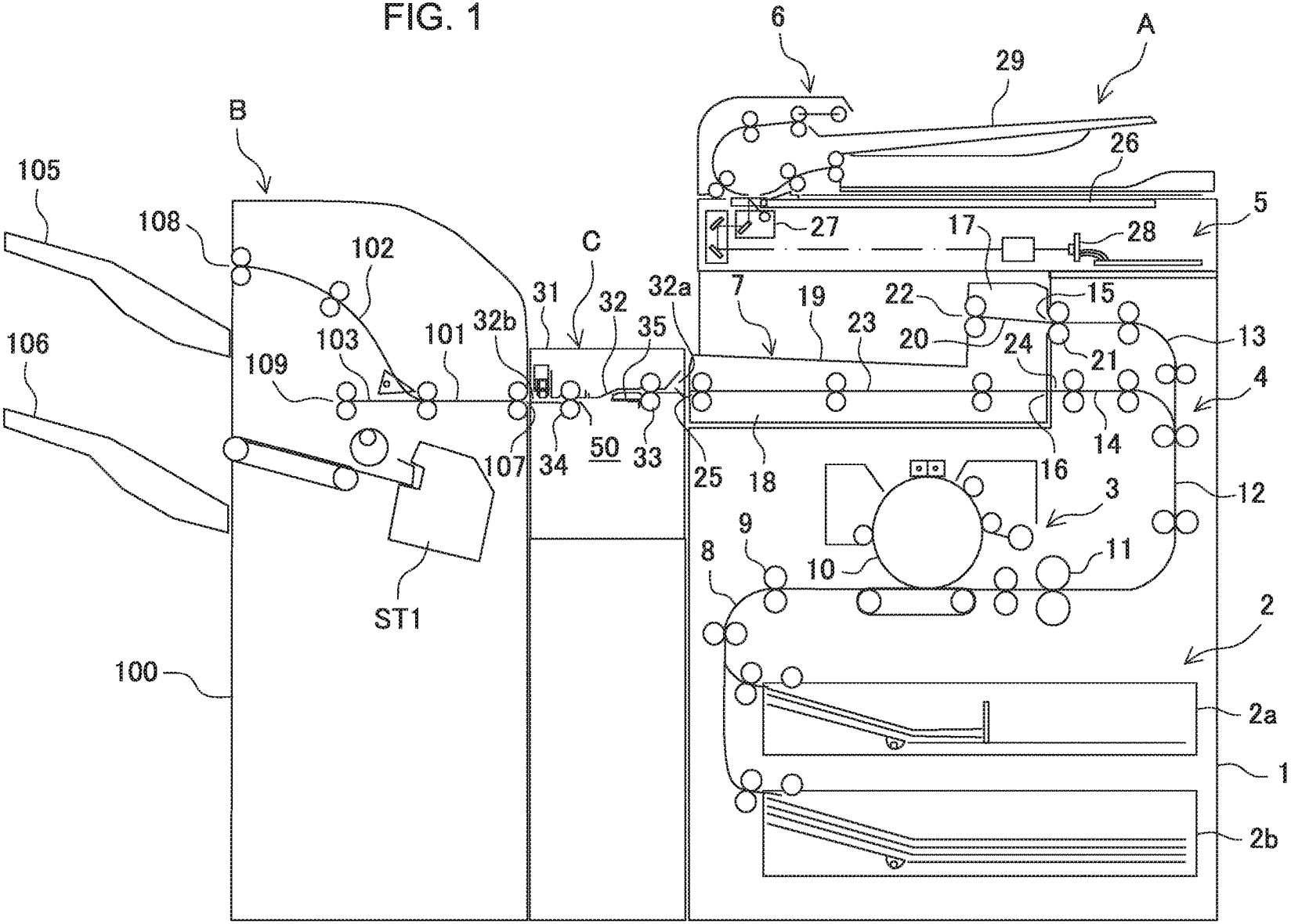
FIG. 1 is an overall configuration diagram of an image forming system utilizing the present invention.

FIG. 1 is an overall configuration diagram of an image forming system utilizing the present invention. The image forming system shown in FIG. 1 comprises an image forming apparatus A, a sheet post-processing apparatus B, and a sheet folding apparatus C coupled between the apparatuses A and B. Any sheet having an image formed in the image forming apparatus A is transported through the sheet folding apparatus C and is ejected onto the ejecting tray of the sheet post-processing apparatus B. Hereinafter, the image forming apparatus A, the sheet post-processing apparatus B and the sheet folding apparatus C will be described.

[Image Forming Apparatus]

The image forming apparatus A is of the type that forms an image on a sheet by using an electrostatic printing mechanism known in the art. The apparatus A has a sheet feeding section 2, an image forming section 3, a sheet ejecting section 4, and a control section (not shown), all provided in an apparatus housing 1. On the housing 1, an image reading section 5 composed of a scanner unit is provided. On the image reading section 5, an automatic document-sheet feeding section 6 is provided, integral with the image reading section 5. The image forming apparatus A according to this embodiment is a so-called internal sheet-ejecting type, and a transport relay unit 7 is arranged in a large front U-shaped sheet-ejecting space defined among the image forming section 3, sheet ejecting section 4 and image reading section 5 shown in FIG. 1. The image forming apparatus A can have, besides the electrostatic printing mechanism, other various image forming mechanisms, such as an ink-jet image forming mechanism, an offset printing mechanism or a silk-screen printing mechanism.

The sheet feeding section 2 has sheet supplying cassettes 2*a* and 2*b*, which hold sheets of one size and sheets of another size, respectively. The cassettes 2*a* and 2*b* can be inserted into, and can be removed from, the housing 1. The sheet feeding section 2 holding sheets, on which images will be formed, feeds a sheet of the size designated by the control section, from the cassette into a sheet supplying passage 8. In the sheet supplying passage 8, registering rollers 9 are provided. The sheet registered, at its front edge, by the registering rollers 9 is supplied, at prescribed timing, to the image forming section 3 which is arranged downstream.

The image forming section 3 has an electrostatic drum 10, and further has a printing head, a developing device, a transfer charger and the like, which are arranged around the electrostatic drum 10. The printing head is composed of, for example, a laser-beam emitter, and forms an electrostatic latent image on the electrostatic drum 10. The developing device applies toner ink to the electrostatic latent image, forming a toner image. The transfer charger transfers the toner image to the sheet. The sheet having the toner image transferred to it is transported to a fixing device 11. The fixing device 11 fixes the toner image by heating and with pressure, and the sheet is transported into the sheet ejecting passage 12 provided in the sheet ejecting section 4.

The sheet ejecting passage 12 branches, at the downstream end, into a first sheet-ejecting passage 13 and a second sheet-ejecting passage 14. The second sheet-ejecting passage 14 is located below the first sheet-ejecting passage 13. The first and second sheet-ejecting passages 13 and 14 are connected to a first ejection port 15 and a second ejection port 16, respectively, which open to the sheet-ejecting space.

The sheet ejecting section 4 may have a sheet circulating passage (not shown). The sheet circulating passage connects the sheet ejecting passage 12 to the sheet supplying passage 8 at, for example, a position upstream the registering rollers 9. The sheet supplied from the image forming section 3 and therefore having an image is switched back into the sheet circulating passage by rotating the sheet ejecting rollers provided in the sheet ejecting passage 12. The sheet is thereby turned upside down and is then transported again to the image forming section 3. Images can therefore be formed on both sides of the sheet.

As illustrated in FIG. 1, the transport relay unit 7 is shaped, substantially in the form of letter L as viewed from front, and has a first relay part 17 and a second relay part 18. The first relay part 17 extends, at the right end, upwards in the sheet-ejecting space. In the sheet-ejecting space, the second relay part 18 extends to the left side of the housing 1, substantially over the entire lateral width of the space. The upper surface of the second relay part 18 defines a sheet-ejected tray 19 which is generally flat in the sheet-ejecting space.

The first relay unit 17 has a first relay passage 20 in it. The first relay passage 20 has a first sheet inlet port 21 and a first sheet outlet port 22. The first sheet inlet port 21 is connected to the first ejection port 15 of the sheet ejecting section 4. The first sheet outlet port 22 is arranged and opens to the sheet-ejecting space, above the sheet-ejected tray 19. At the first relay passage 20, transport rollers are provided near the first sheet outlet port 22 and are driven by a motor incorporated in the first relay part 17. The sheet having an image formed on it and transported from the sheet ejecting section 4 through the first sheet-ejecting passage 13 is transported by the transport rollers, passes through the first relay passage 20 and is transported onto the sheet-ejected tray 19.

The second relay part 18 incorporates a second relay passage 23. The second relay passage 23 has second sheet inlet port 24, which is connected to the second ejection port 16 of the sheet ejecting section 4. The second sheet outlet port 25 of the second relay passage 23 opens, almost in flush with the left side surface of the apparatus housing 1, and is connected to the sheet inlet port of the sheet folding apparatus C as will be described later. In the second relay passage 23, a plurality of rollers are arranged. These rollers are driven by a motor incorporated in the second relay part 18, and transport the sheet. The sheet transported from the sheet ejecting section 4 via the second sheet-ejecting passage 14 and having an image formed on it is transported by the transport rollers to the sheet folding apparatus C through the second relay passage 23.

The image reading section 5 comprises a platen 26 configured to hold a document sheet, a reading carriage 27 configured to move along the platen, and an optical reading unit 28 composed of, for example, a CCD device. The reading carriage 27 scans the document sheet placed on the platen 26, optically reading the document sheet. The optical image thereby generated is opto-electronically converted to image data by the optical reading unit 28. The document-sheet feeding section 6 automatically feeds a document sheet from a sheet supply tray 29 to the platen 26.

In the image forming apparatus A configured as described above, the image reading section 5 reads a document sheet fed from the document-sheet feeding section 6, and the image forming section 3 forms an image on the basis of the image data read by the image reading section 5. If the sheet having the image formed on it need not be folded by the sheet folding apparatus C or be post-processed by the sheet post-processing apparatus B, it is transported from the sheet ejecting section 4 through the first sheet-ejecting passage 13, then passes through the first relay passage 20, and is transported onto the sheet-ejected tray 19 provided in the sheet-ejecting space. If the sheet having the image formed on it need be folded and/or post-processed, it is transported from the sheet ejecting section 4 through the second sheet-ejecting passage 14, then passes through the second relay passage 23 and is sent to the sheet folding apparatus C.

[Sheet Post-Processing Apparatus]

As shown in FIG. 1, the sheet post-processing apparatus B comprises first to third transport paths 101, 102 and 103, a post-process device, and a binding-process tray 104, all provided in the housing 100. Through the first transport path 101, any sheet coming from the sheet folding apparatus C is transported. The second transport path 102 and the third transport path 103 branch from the first transport path 101. The post-process device is, for example, a staple unit ST1. On one side (left side in FIG. 1) of the housing 100, a first ejected-sheet tray 105 and a second ejected-sheet tray 106 are provided, spaced apart in the vertical direction, to receive and accumulate the sheets ejected from the sheet post-processing apparatus B. The sheet post-processing apparatus B is so arranged that the sheet-inlet port 107 of the first transport path 101 is connected to the sheet-outlet port of the sheet folding apparatus C (described later).

The first ejected-sheet tray 105 is arranged below the sheet-outlet port 108 of the second transport path 102, which opens in said side of the housing 100. Any sheet sent from the sheet folding apparatus C is transported from the first transport path 101 onto the second transport path 102 and ejected through the sheet-outlet port 108 onto the first ejected-sheet tray 105 if the staple unit ST1 does not perform a stapling process and/or any other post-process.

The sheet-outlet port 109 of the third transport path 103 is positioned above the binding-process tray 104, opposing the sheet-mounting surface of the binding-process tray 104. To be stapled together by the staple unit ST1, the sheets sent from the sheet folding apparatus C are transported from the first transport path 101 to the third transport path 103 and are ejected from the sheet-outlet port 109 of the path 103 onto the sheet holding surface of the binding-process tray 104. The sheets accumulated on the binding-process tray 104 are stapled together, forming a sheet bundle, by the staple unit ST1. The sheet bundle is transported from the binding-process tray 104 to the second ejected-sheet tray 106 located downstream the binding-process tray 104.

[Overall Configuration of the Sheet Folding Apparatus]

Figure 2:
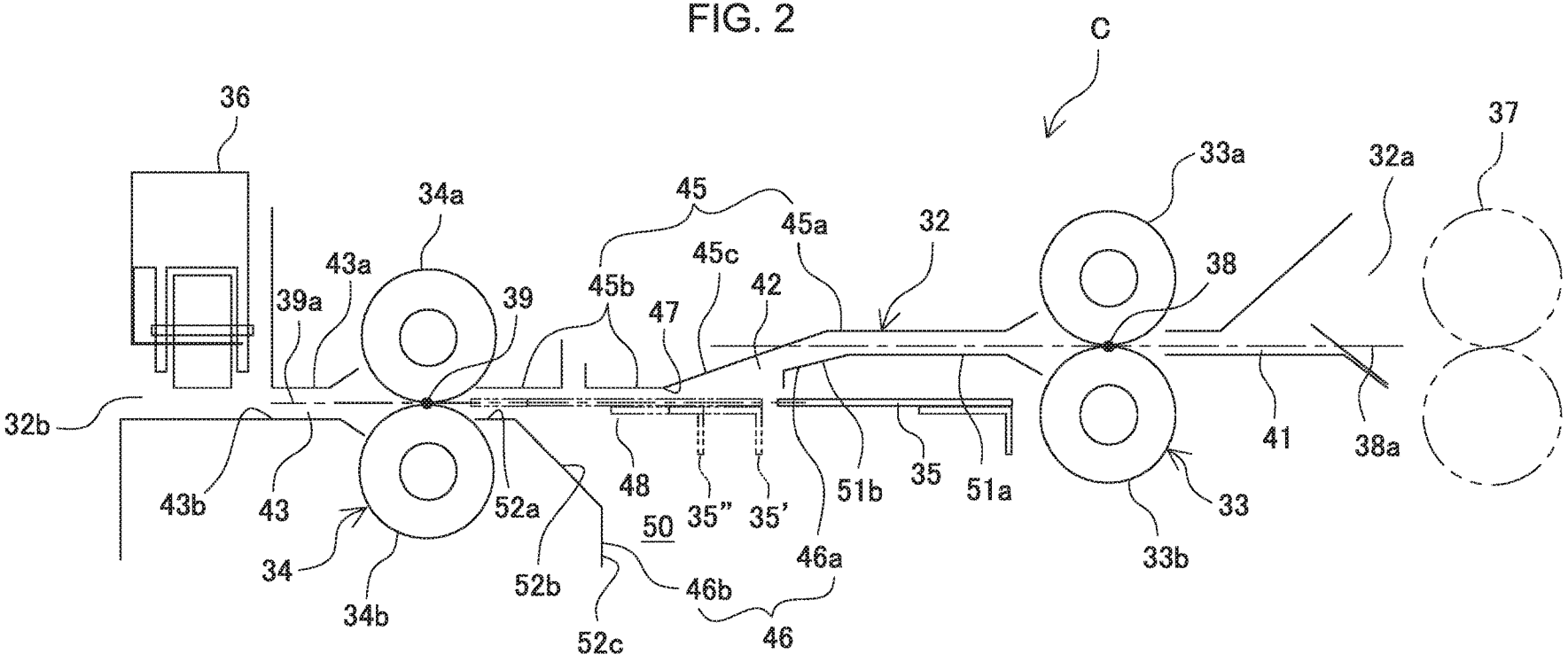
FIG. 2 is a schematic diagram of a sheet folding apparatus according to the present invention.

As shown in FIG. 2, the sheet folding apparatus C has a housing 31 and a transport path 32 provided in the housing 31. The transport path 32 extends from the sheet-inlet port 32*a* of the image forming apparatus A to the sheet-outlet port 32*b* of the sheet post-processing apparatus B. At the transport path 32, a registering-roller pair 33 and a folding-roller pair 34 are arranged, respectively at upstream and downstream parts, in the sheet transporting direction, and a pushing plate 35 is arranged between the roller pairs 33 and 34. The sheet folding apparatus C is so configured that, as described above, the sheet-inlet port 32*a* is connected to the second sheet outlet port 25 of the transport relay unit 7 provided in the image forming apparatus A and the sheet-outlet port 32*b* is connected to the sheet-inlet port 107 of the sheet post-processing apparatus B.

Further, an additional-folding mechanism 36 may be provided, as an optional component, near the sheet-outlet port 32*b* of the transport path 32. It has been well known to anyone skilled in the art that in a folding apparatus such as the sheet folding apparatus C, an additional-folding mechanism for pressing the sheet at a position downstream the sheet-folding section is used in order to fold the sheet reliably at the sheet-folding position.

[Registering-Roller Pair]

The registering-roller pair 33 is composed of a driving roller 33*a* and a driven roller 33*b*, which are arranged above and below the transport path 32, respectively. The driven roller 33*b* has its surface pressed to the surface of the driving roller 33*a* by, for example, an appropriate spring unit (not shown). Therefore, the driven roller 33*b* is rotated if the driving roller 33*a* is driven by a registering motor which will be described later.

The sheet transported from the transport relay unit 7 of the image forming apparatus A by an ejecting roller pair 37 provided near the second sheet outlet port 25 has its front edge abut on a nip part 38 of the registering-roller pair 33 not rotating. The sheet therefore is registered at its front edge. The sheet having its front edge so registered is transported toward the folding-roller pair 34 through the transport path 32, as the registering-roller pair 33 is driven at a prescribed timing.

In an another embodiment, the registering-roller pair 33 can be replaced by ejecting rollers (equivalent to the ejecting roller pair 37) which eject the sheet from the image forming apparatus A to the sheet folding apparatus C. This reduces the number of components constituting the sheet folding apparatus C, lowering the manufacturing cost and rendering the apparatus C shorter in the sheet transporting direction. In this case, the ejecting roller pair 37 should better have a function of aligning the sheet transported to the transport path 32, at its front edge, as described above.

[Folding-Roller Pair]

The folding-roller pair 34 consists of an upper folding roller 34*a* and a lower folding roller 34*b* provided across the transport path 32. The rollers 34*a* and 34*b* are pressed to each other, at their surfaces, by an appropriate spring unit (not shown), nip the front edge and folding line of each sheet transported from the registering-roller pair 33 and fold the sheet. Further, the rollers 34*a* and 34*b* pressed to each other are driven, in unison, by a folding motor described later, and rotate to transport the sheet.

The folding-roller pair 34 is arranged above the tangential line 39*a* passing a nip part 39 where the rollers press each other, positioning the nip 38 of the registering-roller pair 33 above the tangential line 39*a*. In the embodiment of FIG. 2, the tangential line 39*a* and the tangential line 38*a* passing the nip part 38 of the registering-roller pair 33 are almost horizontal at different heights, the tangential line 38*a* located above the tangential line 39*a*.

[Transport Path]

As shown in FIG. 2, the transport path 32 is composed of a sheet inlet path 41 which extends from the sheet-inlet port 32*a* to the registering-roller pair 33, a path 42 which extends from the registering-roller pair to the folding-roller pair 34, and a sheet outlet path 43 which extends from the folding-roller pair 34 to the sheet-outlet port 32*b*.

The sheet inlet path 41 has an upper inlet guide 41*a* and a lower inlet guide 41*b* which are arranged one above the other and extend in the sheet transporting direction and which guides the front edge of the sheet to the nip part 38 of the registering-roller pair 33. The upper inlet guide 41*a* greatly flares out upwards from the point near the registering-roller pair 33 toward the inlet side to provide a space large enough to allow the sheet to warp and form a loop as it is transported from the upstream side to the ejecting roller pair 37, as the front edge of the sheet abuts on the nip part 38 of the registering-roller pair 33 and is thereby aligned.

As illustrated in FIG. 2, the path 42 has a first horizontal part (third passage) 45*a* horizontally extending downstream along the tangential line 38*a* passing the nip part 38 of the registering-roller pair 33, a second horizontal part (first passage) 45*b* horizontally extending upstream along the tangential line 39*a*, and an inclining part (second passage) 45*c* inclining downward from the upstream side to the downstream side as if connecting the tangential lines 38*a* and 39*a*. The path 42 has an upper transport guide 45 and a lower transport guide 46 which extend in the sheet transporting direction and which are arranged, one above the other, in order to guide the sheet, aligned at front edge by the registering-roller pair 33, to the nip part 39 of the folding-roller pair 34. The sheet is transported through the path 42, while being restricted, at both sides in the thickness direction, by the upper and lower transport guides 45 and 46.

As described above, the tangential line 38*a* passing the nip part 38 of the registering-roller pair 33 and the tangential line 39*a* passing the nip part 39 of the registering-roller pair 34 extend parallel to each other and are arranged one above the other. Therefore, the upper transport guide 45 has a first horizontal part 45*a* horizontally extending downstream along the tangential line 38*a*, a second horizontal part 45*b* horizontally extending upstream along the tangential line 39*a*, and an inclining part 45*c* extending downward from the upstream side to the downstream side as if connecting the tangential lines 38*a* and 39*a*.

As shown in FIG. 2, the inclining part 45*c* is formed, linearly extending upward and slantwise, from the upstream end of the second horizontal part 45*b* toward the upper-right corner of FIG. 2. The inclining part 45*c* and the second horizontal part 45*b* extend straight and intersect with each other. At the position where the parts 45*c* and 45*b* intersect, there is formed a protrusion 47 having a relatively large obtuse angle and extending almost downward from the path 42. Similarly, the part connecting the inclining part 45*c* and the first horizontal part 45*a* has a relatively large obtuse angle.

In another embodiment, the part connecting the inclining part 45*c* and the second horizontal part 45*b* may be curved. In this case, the protrusion 47 is shaped, protruding almost downward from the path 42. The part connecting the inclining part 45*c* and the first horizontal part 45*a* may be curved similarly. In still another embodiment, the second horizontal part 45*b* and inclining part 45*c* of the upper transport guide 45 may be separate members, and may constitute the protrusion 47.

In this embodiment, as shown in FIG. 2, the upstream parts of the first horizontal part 45*a*, inclining part 45*c* and second horizontal part 45*b* are formed of a single member, i.e., first upper transport guide member. The downstream part of the second horizontal part 45*b* is formed of a second upper transport guide member. The first and second upper transport guide members are arranged, substantially connected to each other, not to make any trouble in the sheet transport in the path 42. Further, the first upper transport guide member can be composed of a plurality of guide members which are substantially continuous to one another. Still further, the junction of the first and second upper transport guide members can be provided at various positions other than the position shown in FIG. 2.

The lower transport guide 46 has a first lower guide part 46*a* and a second lower guide part 46*b*. The first lower guide part 46*a* extends in the downstream direction, from the registering-roller pair 33 to a prescribed position in the sheet transporting direction. The second lower guide part 46*b* extends in the upstream direction, from the folding-roller pair 34 to a prescribed position in the sheet transporting direction. The first lower guide part 46*a* and the second lower guide part 46*b* are secured to the housing 31, defining, between them, a large space 48 extending in the sheet transporting direction. The space 48 between the first lower guide part 46*a* and the second lower guide part 46*b* can be opened and closed by the pushing plate 35 which can horizontally move toward or retreats from the nip part 39 of the folding-roller pair 34 as will be described later.

As shown in FIG. 2, a relatively large loop-forming space 50 is provided below the space 48 of the lower transport guide 46. If the pushing plate 35 retreats (see solid lines in FIG. 2), opening the space 48, the sheet in the path 42 can hang from the space 48 into the loop-forming space 50. The pushing plate 35 may move forward (see broken lines 35' in FIG. 2), closing the space 48. In this case, the sheet transported from the registering-roller pair 33 can be transported toward the folding-roller pair 34 along the path 42, without hanging in the loop-forming space 50.

The first lower guide part 46*a* has a first horizontal guide part 51*a* and a first inclining guide part 51*b*. The first horizontal guide part 51*a* extends horizontally from the registering-roller pair 33 to the downstream side, while opposing the first horizontal part 45*a* of the upper transport guide 45. The first inclining guide part 51*b* extends downward, from the first horizontal guide part 51*a*, almost parallel to the middle part of the inclining part 45C of the upper transport guide 45. The downstream end of the first inclining guide part 51*b* defines the hanging start position of sheet when the space 48 is opened. In this embodiment, the lower end of the first inclining guide part 51*b* is located above the tangential line 39*a* extending through the nip part 39 of the folding-roller pair 34.

The second lower guide part 46*b* is constituted by a single lower transport guide 46 having a second horizontal guide part 52*a*, a second inclining guide part 52*b* and a vertical guide part 52*c*. The second horizontal guide part 52*a* horizontally extends from the folding-roller pair 34 in upstream direction. The second inclining guide part 52*b* inclines downwards in upstream direction, from the second horizontal guide part 52*a*. The vertical guide part 52*c* extends downward, almost vertically, from the second horizontal guide part.

The second horizontal guide part 52*a* cooperates with the second horizontal part 45*b* of the upper transport guide 45, and guides the front edge of the sheet to the nip part 39 of the folding-roller pair 34, while restricting the sheet at both side in the thickness direction, namely the vertical direction. The second inclining guide part 52*b* inclines toward the loop-forming space 50, to guide the sheet hanging in the loop-forming space 50, into the nip part 39 of the folding-roller pair 34. The second inclining guide part 52*b* cooperates with the vertical guide part 52*c*, isolating the sheet hanging in the loop-forming space 50 from the folding-roller pair 34, while maintaining a sufficient size of the loop-forming space 50.

While the pushing plate 35 remains in the retreat position, the sheet transported from the registering-roller pair 33 to the path 42 may move beyond the downstream end of the first inclining guide part 51*b*. In this case, the sheet transported from the registering-roller pair 33 to the path 42 hang down linearly, first at its front edge, through the open space 48 into the loop-forming space 50. If the space 48 is opened while the front edge of the sheet remains nipped by the folding-roller pair 34 and the folding-roller pair 34 are stopped, the sheet in the path 42 is curved and hangs down, in the shape of a loop, through the space 48 into the loop-forming space 50.

Figure 3:
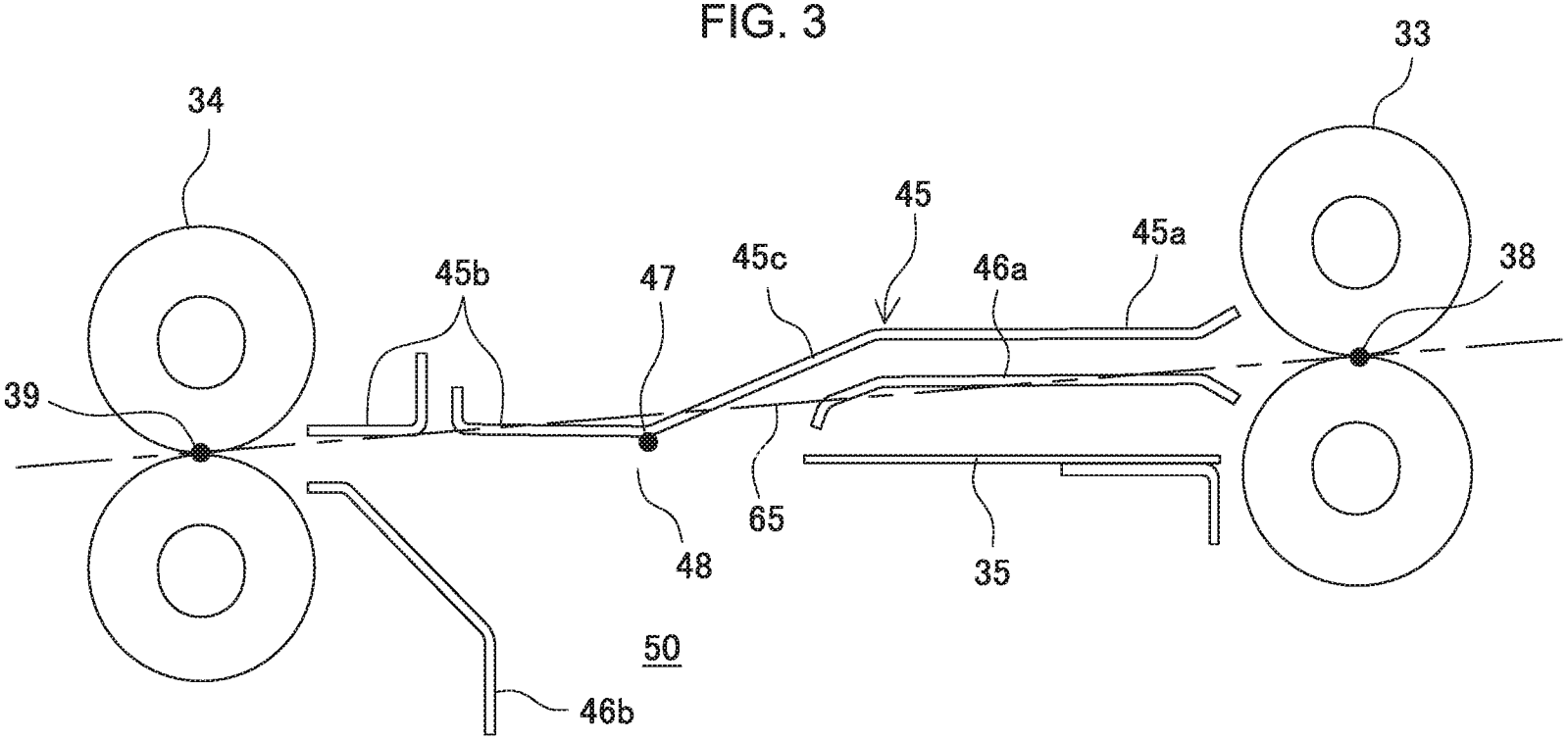
FIG. 3 is an explanatory view showing an arrangement of a protrusion in the sheet transporting direction in a path.
Figure 4:
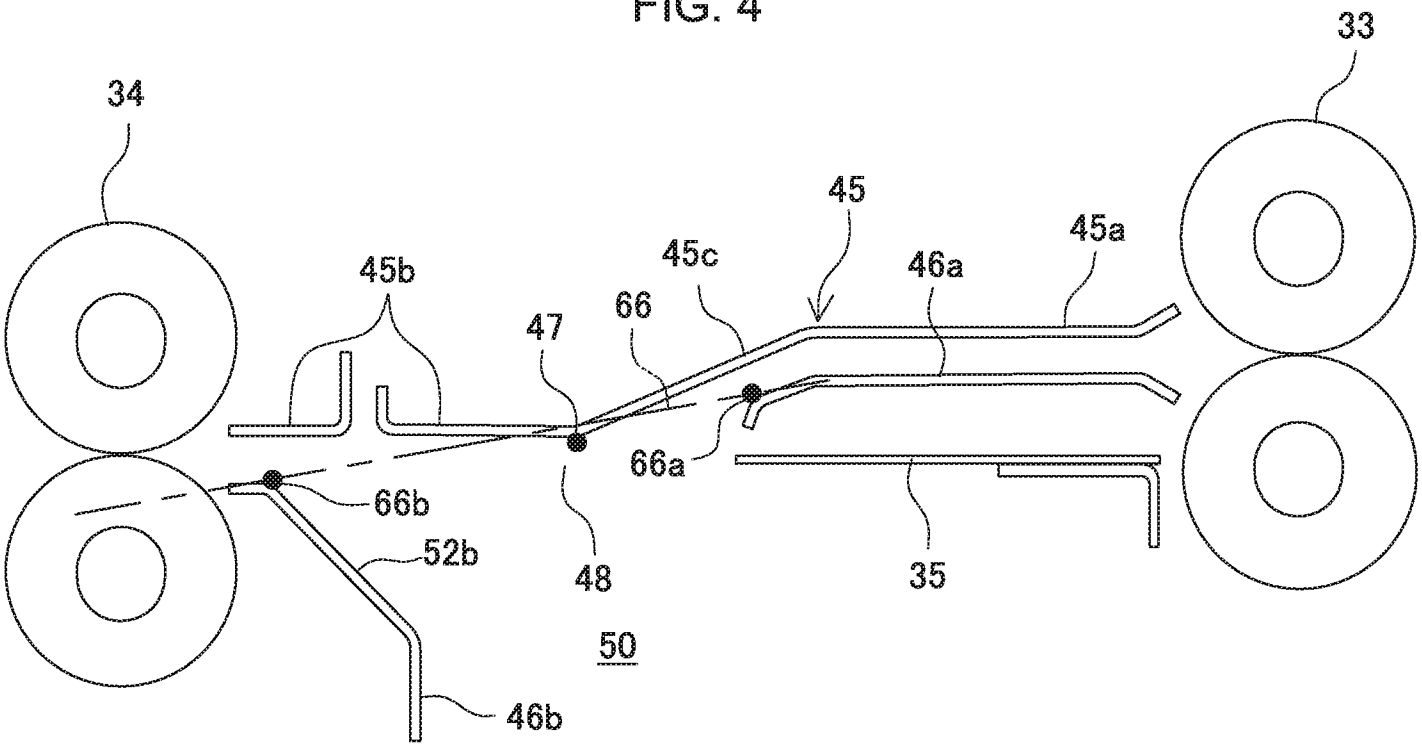
FIG. 4 is an explanatory view showing another arrangement of the protrusion in the sheet transporting direction in the path.

It is favorable to arrange the protrusion 47 of the upper transport guide 45 almost at the center of the space 48 along the sheet transporting direction, and hence, in one embodiment, as shown in FIG. 3, the protrusion 47 is arranged so as to be positioned lower than a linear line 55 connecting the nip part 38 of the registering-roller pair 33 and the nip part 39 of the folding-roller pair 34, that is, on the side of the loop-forming space 50.

Due to the stiffness of sheet, it is difficult, as compared to a center portion of the space 48, to make the sheet curve downward at a location near the downstream end of the first lower guide part 46*a* and at a location near the upstream end of the second horizontal guide part 52*a* of the second lower guide part 46*b*, when viewing the path 42 in the sheet transporting direction. When the protrusion 47 is arranged as illustrated in FIG. 3, the sheet is curved, bulging out near the center portion of the space 48, toward the side of loop-forming space 50, in the sheet transporting direction. Therefore, the sheet nipped, at the front edge, by the folding-roller pair 34 in the path 42 can be bent more smoothly and stably, forming a loop toward the loop-forming space 50.

Figure 6:
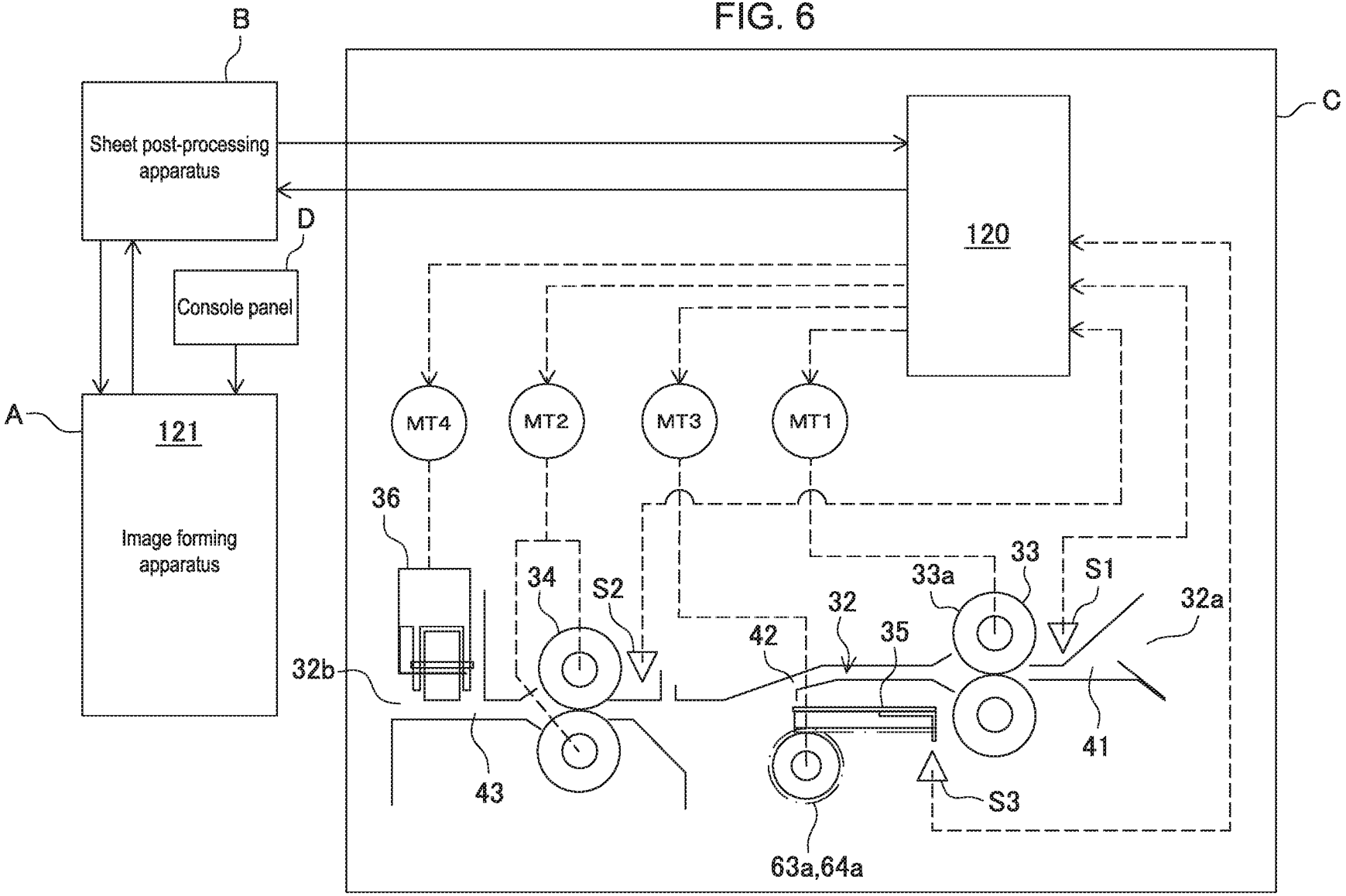
FIG. 6 is a block diagram showing the control system of the sheet folding apparatus.

According to another embodiment, the protrusion 47, as illustrated in FIG. 6, may be positioned lower than a linear line 56 connecting a downstream-side end 56*a* of the first lower guide part 46*a* as the upstream part of the lower transport guide 46 and an upstream end 56*b* of the second horizontal guide part 52*a* of the second lower guide part 46*b* as the downstream part of the lower transport guide 46, namely on the side of the loop-forming space 50. Herein, the downstream end 56*a* of the first lower guide part 46*a* is the support, at the most downstream side of the first lower guide part 46*a*, for supporting the lower surface of the sheet in the path 42, while the upstream end 56*b* of the second horizontal guide part 52*a* is the support, at the most upstream side of the second horizontal guide part 52*a*, for supporting the lower surface of the sheet in the path 42.

So arranged as illustrated in FIG. 6, the protrusion 47 is positioned upstream from the center position of the space 48 when viewed in the sheet transporting direction, allowing the loop-forming space 50 to be occupied more largely at the downstream side from the protrusion 47 than at the upstream side therefrom. The sheet in the path 42 nipped, at its front edge, by the folding-roller pair 34 can therefore be bent more smoothly, by the function of the protrusion 47, forming a loop toward the loop-forming space 50.

The path 42 is substantially continuous, in the sheet transporting direction, above the upper surface of the sheet, due to the upper transport guide 45 composed of the first and second upper transport guide members. Below the lower surface of the sheet, the path 42 is composed of the fixed first lower guide portion 46*a*, fixed second lower guide portion 46*b* and the pushing plate 35 having been moved.

In another embodiment, the path 42 may be composed of only a horizontal guide part, not using the first inclining guide part 51*b*. As shown in FIG. 2, the upper transport guide 45 is designed such that the junction of the inclining part 45*c* and second horizontal part 45*b* is located in the space 48. The invention is not limited to this. In the second lower guide part 46*b* also, the second inclining guide part 52*b* may be made smaller than shown in FIG. 2 or may not be used so long as the sheet hanging down into the loop-forming space 50 is guided to the nip part 39 of the folding-roller pair 34. The vertical guide part 52*c* can therefore be made smaller or may not be used at all, provided that the loop-forming space 50 is sufficiently large.

The sheet outlet path 43 has an upper transport guide 43*a* and a lower transport guide 43*b* which are arranged in the sheet transporting direction and one above the other, in order to guide any sheet folded to the sheet-outlet port 32*b*. In front of the sheet-outlet port 32*b*, an additional-folding mechanism 36 is provided. The mechanism 36 has a plurality of rolling members that move on the lower transport guide 43*b* in, for example, a direction which intersects with the sheet widthwise direction, thereby to further fold the sheet that has been folded already.

[Pushing Plate]

As show in FIGS. 2 and 5, the pushing plate 35 is made of a flat plate that extends in the sheet widthwise direction of the path 42. The pushing plate 35 is arranged horizontal and at almost the same height as the nip part 39 of the folding-roller pair 34. The pushing plate 35 is arranged, able to move in horizontal direction to a retreat position (indicated by solid lines in FIG. 2) below the first lower guide part 46*a*, and between a guiding position (indicated by broken lines 35' in FIG. 2) and a pushing position (indicated by broken lines 35" in FIG. 2).

While the pushing plate 35 remains at the retread position, the space 48 of the lower transport guide 46 fully opens, and the path 42 therefore has its second passage part opened to the loop-forming space 50 located below. The sheet in the path 42 can therefore hang down in the loop-forming space 50.

At the guiding position indicated by the broken lines 35', the pushing plate 35 completely closes the space 48 of the lower transport guide 46, opposes the upper transport guide 45 in the vertical direction at the same time, and forms a part of the lower transport guide 46. The sheet is guided from the path 42 into the second passage part, without hanging down in the loop-forming space 50. Then, the sheet is transported from the first passage part to the third passage part.

While remaining at the pushing position indicated by broken lines 35", the pushing plate 35 enters the gap between the second horizontal part 45*b* of the upper transport guide 45 and the second horizontal guide part 52*a* of the second lower guide part 46*b* in the third passage part. This pushing position is a position where the pushing plate 35 moves the folding line of the sheet to the nip part 39 of the folding-roller pair 34.

Figure 5A:
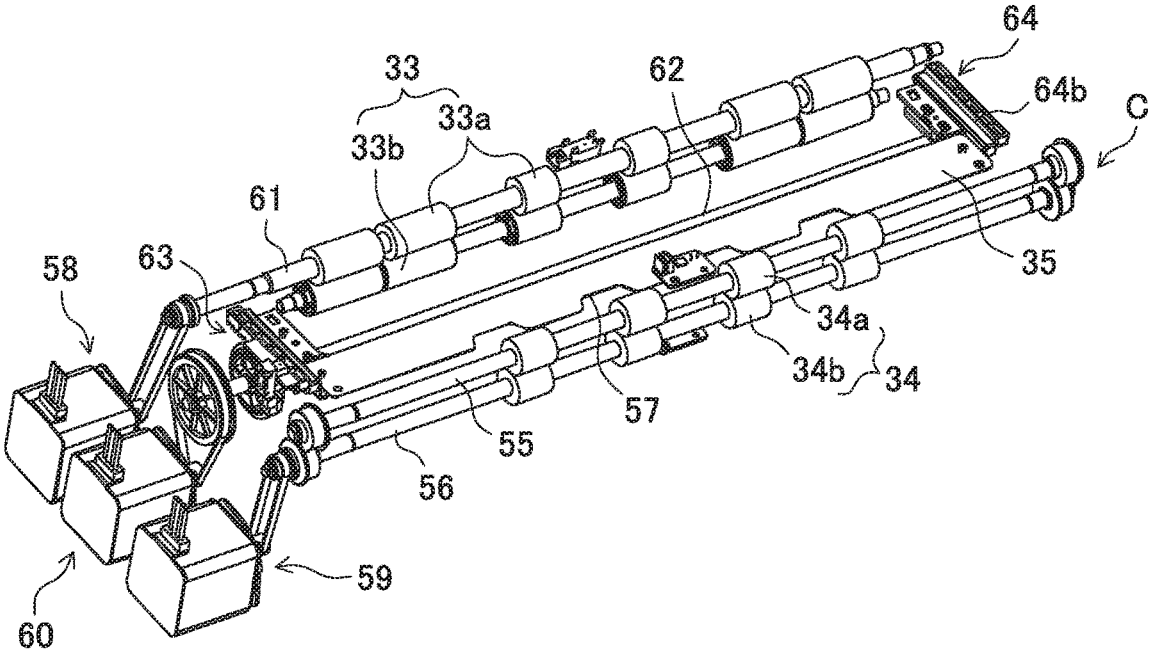
FIG. 5A is a perspective view of the entire drive mechanism of the sheet folding apparatus.
Figure 5B:
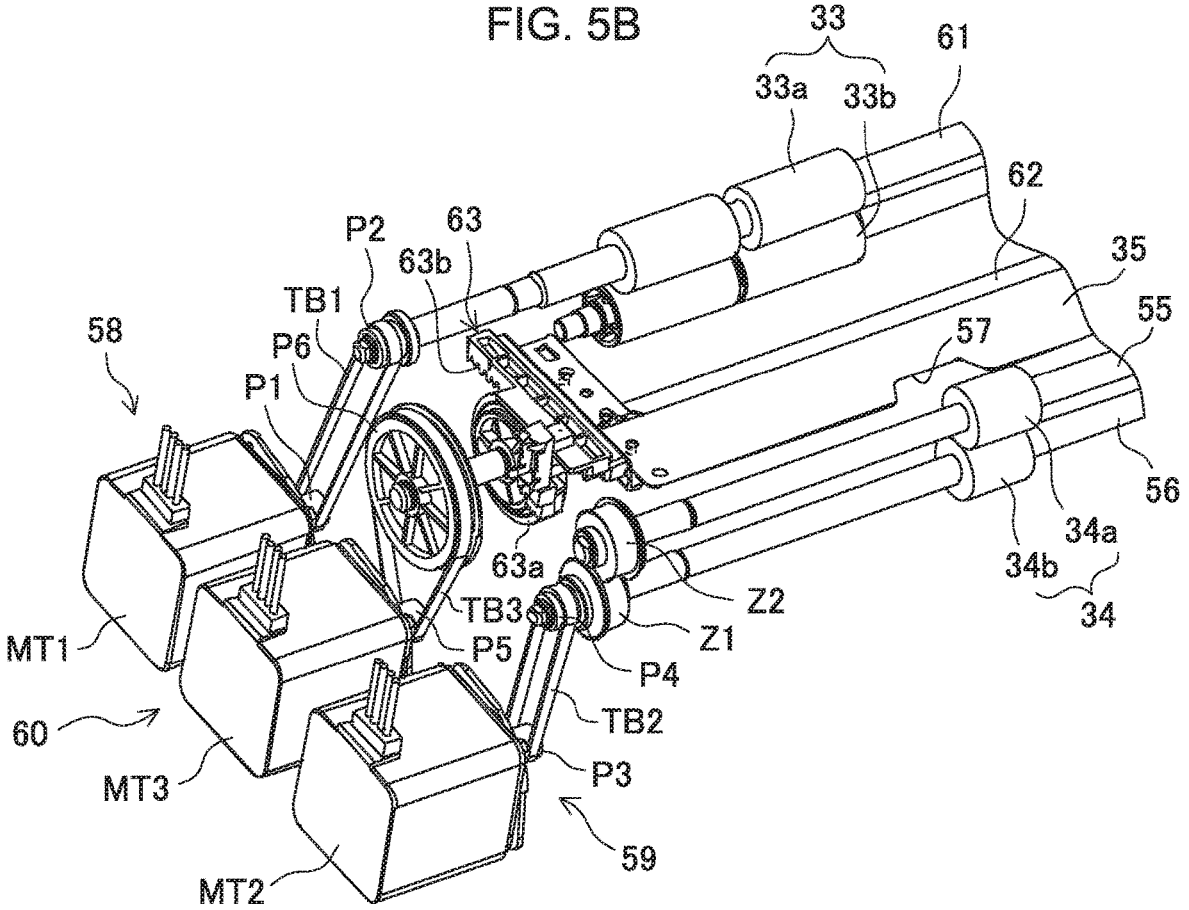
FIG. 5B is an enlarged view of the major parts of the drive mechanism.

FIGS. 5A and 5B show the configuration of the pushing plate 35, in more detail. As these figures show, the four folding roller pairs, each composed of lower folding rollers 34*a* and 34*b*, are mounted on an upper roller shaft 55 and a lower roller shaft 56 in this embodiment. Of the four roller pairs, two pairs are arranged symmetric to the other two pairs with respect to the middle parts of the roller shafts 55 and 56 in the axial direction thereof. The front edge of the pushing plate 35 has four notches 57 arranged in the sheet widthwise direction. The notches 57 are positioned at the associated folding-roller pairs 34, respectively, each having shape and size corresponding to those of the associated folding-roller pair 34.

The pushing plate 35 is moved to the retread position and between the guiding position and the pushing position, by the pushing motor MT3 provided in a drive mechanism shown in FIG. 5. The pushing motor MT3 is driven and controlled by a control section 120 shown in FIG. 6, as will be described hereinafter.

[Drive Mechanism in the Sheet Folding Apparatus]

FIGS. 5A and 5B show drive mechanisms 58 to 60 for driving the registering-roller pair 33, folding-roller pair 34 and pushing plate 35, respectively, in the sheet folding apparatus C. The registering-roller pair 33 is provided, allowing the driving roller 33*a* to rotate together with a roller shaft 61 that can rotate in the sheet-width direction. The folding-roller pair 34 is composed of an upper folding roller 34*a* and a lower folding roller 34*b*. The upper and lower folding rollers 34*a* and 34*b* are mounted on the roller shafts 55 and 56, respectively, which are provided so as to be rotatable in the sheet widthwise direction and can rotate as the roller shafts 55 and 56 are rotated.

The drive mechanism 58 for driving the registering-roller pair 33 comprises a transport motor MT1, a drive pulley P1 mounted on the shaft of the transport motor MT1, a driven pulley P2 mounted on one end of the roller shaft 61 of the driving roller 33*a*, and a timing belt TB1 wrapped around both pulleys P1 and P2. The drive force of the transport motor MT1 is transmitted from the shaft of the transport motor MT1 to the driving roller 33*a* through the transmission mechanism composed of the drive pulley P1, timing belt TB1 and driven pulley P2.

A drive mechanism 59 for driving the folding rollers 34 comprises a folding motor MT2, a driving pulley P3 mounted on the shaft of the motor MT2, a driven pulley P4 mounted on the roller shaft 56 of the lower folding roller 34*b*, and a timing belt TB2 wrapped around both pulleys P3 and P4. The drive mechanism 59 further comprises gears Z1 and Z2. The gear Z1 is mounted coaxially on the roller shaft 56, and can rotate as the roller shaft 56 is driven. The gear Z2 is mounted coaxially on the roller shaft 55, and can rotate as the roller shaft 55 of the upper folding roller 34*a* is driven.

The drive force of the folding motor MT2 is transmitted from the shaft of the motor MT2 to the lower folding roller 34*b* through the transmission mechanism composed of the driving pulley P3, timing belt TB2 and driven pulley 4. Further, the drive force of the folding motor MT2 is transmitted from the roller shaft 56 having the driven pulley P4 to the upper folding roller 34*a* through the gears Z1 and Z2 which are in mesh with each other. The upper folding roller 34*a* and the lower folding roller 34*b* therefore rotate at the same time in opposite directions, and can cooperate to transport the sheet nipped by the rollers 34*a* and 34*b* in the sheet transporting direction.

The drive mechanism 60 for driving the pushing plate 35 comprises the pushing motor MT3, a driving pulley P5, a rotary shaft 62, a driven pulley P6, a timing belt TB3, a first rack-pinion mechanism 63, and a second rack-pinion mechanism 64. The driving pulley P5 is mounted on the shaft of the pushing motor MT3. The rotary shaft 62 extends in the sheet widthwise direction. The driven pulley P6 is mounted on one end of the rotary shaft 62. The timing belt TB3 is wrapped around both pulleys P5 and P6. The first rack-pinion mechanism 63 is arranged at one end of the rotary shaft 62 and located inner than the driven pulley P6. The second rack-pinion mechanism 64 is provided at the other end of the rotary shaft 62.

The first rack-pinion mechanism 63 has a first pinion 63*a* and a first rack 63*b*. The first pinion 63*a* is mounted on one end of the rotary shaft 62, positioned more inner than the driven pulley P6, and can rotate as the shaft 62 is driven. The first rack 63*b* is provided on one end of the pushing plate 35 and meshes with the first pinion 63*a*. Similarly, the second rack-pinion mechanism 64 has a second pinion 64*a* and a second rack 64*b*. The second pinion 64*a* is mounted on the other end of the rotary shaft 62, and can rotate as the shaft 62 is driven. The second rack 64*b* is provided on the other end of the pushing plate 35 and meshes with the second pinion 64*a*. The first and second racks 63*b* and 64*b* are arranged so that the pushing plate 35 synchronously moves in the same direction to move the first and second pinions 63*a* and 64*a* in the horizontal direction.

The drive force of the pushing motor MT3 is transmitted from the shaft thereof to the first pinion 63*a* and second pinion 64*a* through the transmission mechanism composed of the driving pulley P5, timing belt TB3 and driven pulley P6. Therefore, the first and second racks 63*b* and 64*b* move synchronously in the same direction, and move the pushing plate 35 in the horizontal direction.

[Control System in the Sheet Folding Apparatus]

FIG. 6 schematically shows the control system of the sheet folding apparatus C. The sheet folding apparatus C comprises a control section 120 composed of a control board that includes a CPU. As shown in FIG. 5, the control section 120 has first to third detection sensors S1, S2 and S3 which are arranged along the transport path 32.

The first detection sensor S1 is arranged in front of the registering-roller pair 33 of the sheet inlet path 41, and detects the front edge of the sheet transported from the image forming apparatus A through the sheet-inlet port 32*a*. The second detection sensor S2 is arranged in front of the folding-roller pair 34 of the path 42, and detects the front edge of the sheet transported from the registering-roller pair 33 to the folding-roller pair 34. The third detection sensor S3 detects the position of the pushing plate 35 moving to the retreat position, the guiding position or the pushing position. The outputs of the first to third detection sensors S1 to S3 are supplied to the control section 120 in real time.

The control section 120 is connected to the control section 121 of the image forming apparatus A, by the sheet post-processing apparatus B. The control section 121 is connected to the input section (not shown) and the display section (not shown), both incorporated in the console panel D of the image forming apparatus A. The data, such as the sheet type the user has set on the console panel D of the image forming apparatus A, and the data, such as the sheet-folding mode in which to operate the sheet folding apparatus C are transmitted from the control section 121 to the control section 120 through the sheet post-processing apparatus B.

The control section 120 is connected to the transport motor MT1, folding motor MT2 and pushing motor MT3. When providing the additional-folding mechanism 36, the control section 120 is also connected to an additional-folding drive motor MT4. On the basis of the outputs from the first to third detection sensors S1 to S3 and the various data items received from the control section 121 of the image forming apparatus A, the motors MT1 to MT3 and, optionally, MT4, are controlled, thereby controlling the sheet transportation in the transport path 32 and the sheet-folding process in the sheet folding apparatus C.

The control section 120 can transmit, in real time, the information about the sheet transportation and sheet folding, both performed in the sheet folding apparatus C, to the control section 121 of the image forming apparatus A through the post-processing apparatus B. If the information received from the control section 120 contains alarm data or undesirable data representing sheet-transportation error or insufficient sheet folding, the alarm or the undesirable data can be displayed at, for example, the display unit of the console panel D.

Figure 7:
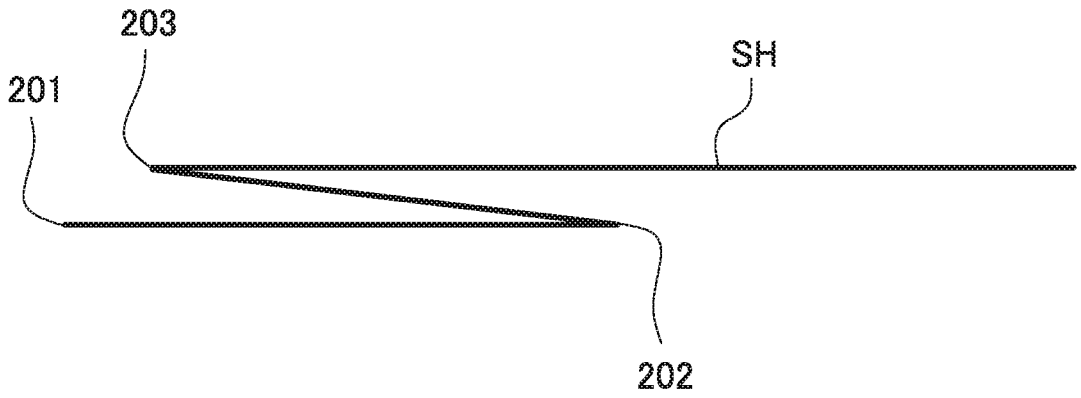
FIG. 7 is an end view illustrating a sheet that has been three-folded (i.e., Z-folded) by the sheet folding apparatus.

The sheet folding apparatus C according to the present embodiment can fold a sheet along two parallel lines along the sheet transporting direction to achieve the so-called Z-folding. FIG. 7 illustrates a sheet SH Z-folded by the sheet folding apparatus C, as viewed in the sheet widthwise direction. As shown in FIG. 7, the sheet SH has a first folding line 202 at a preset distance from the front edge (downstream edge) 201 in the sheet widthwise direction, and a second folding line 203 at a preset distance from the first folding line 202 in the downstream direction. How the sheet folding apparatus C folds a sheet will be described hereinafter.

[Sheet-Folding Process in the Sheet Folding Apparatus]

A Z-folding mode of folding a sheet along two lines and a non-folding mode of not folding a sheet at all are preset in the sheet folding apparatus C. Before starting the image-forming process in the image forming apparatus A, the user determines which process, the image-forming process or the sheet-folding process, should be performed. To perform the sheet-folding process, the sheet-folding mode is selected and input at the console panel D. The sheet-folding mode is stored, as information about the sheet subject to folding process, in the control section 121 of the image forming apparatus A.

Figure 8:
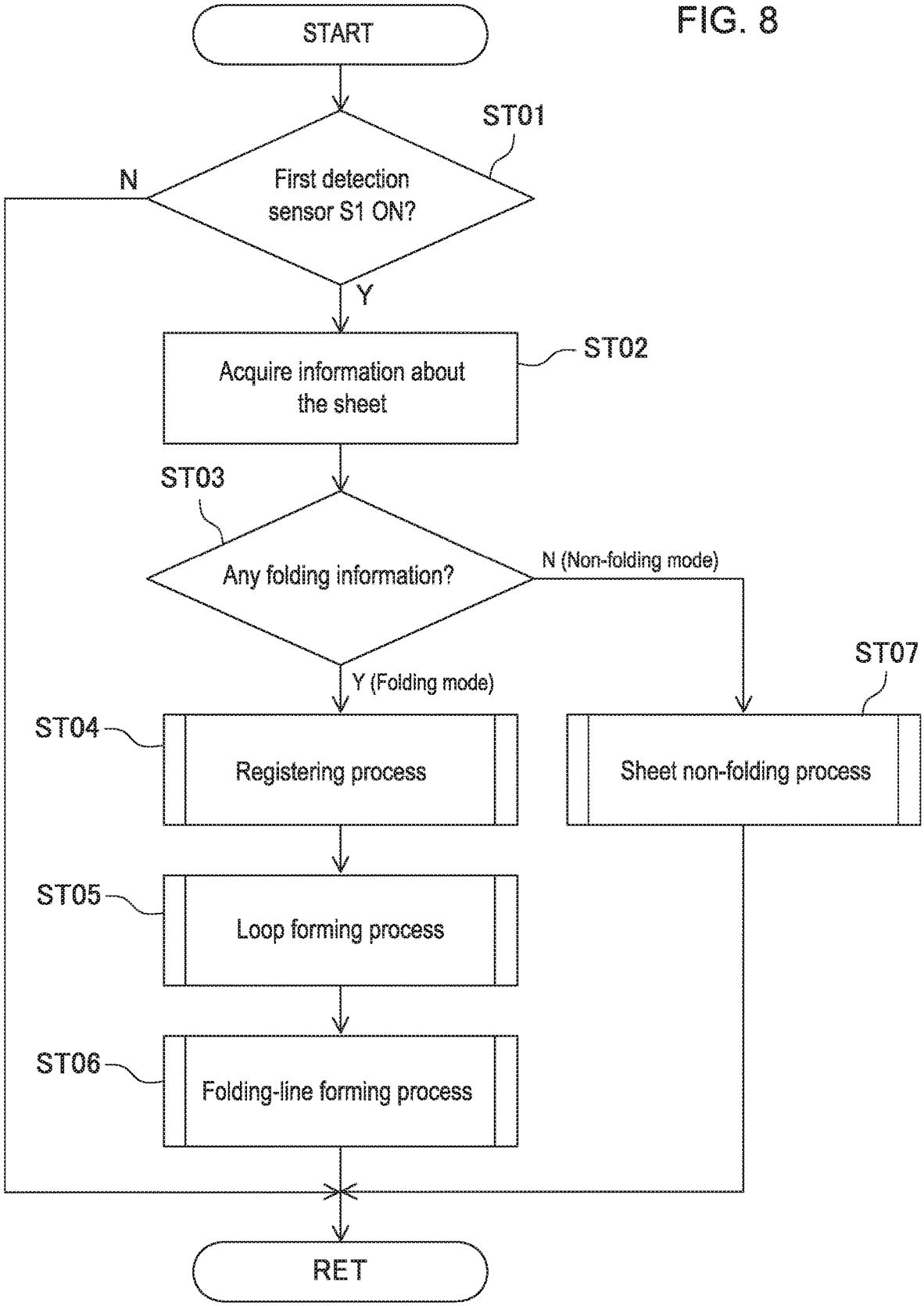
FIG. 8 is a flowchart explaining the entire sequence of sheet-folding steps performed in the sheet folding apparatus.
Figure 10:
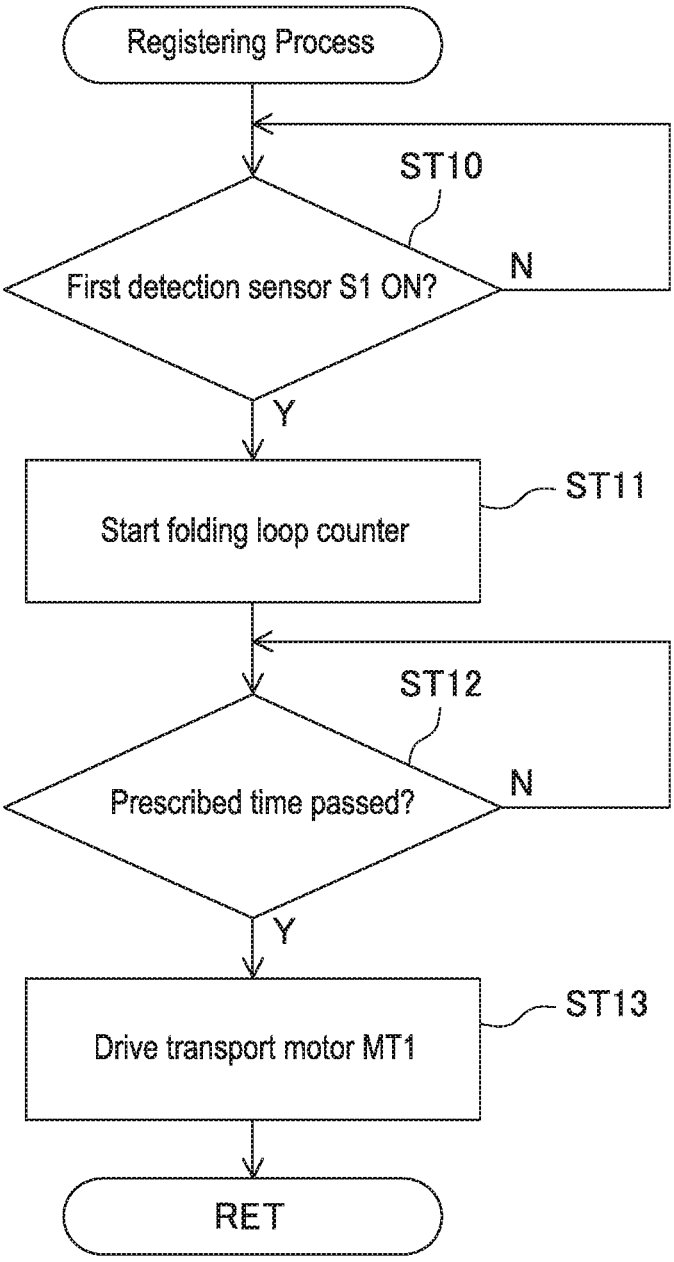
FIG. 10 is a flowchart explaining the registering step performed in the sheet folding apparatus.

How the sheet folding apparatus C operates will be explained briefly, with reference to the flowchart of FIG. 8. First, if the first detection sensor S1 detects the front edge of the sheet transported to the sheet inlet path 41 (if Y in Step ST01), the control section 120 of the sheet folding apparatus C uses the output of the sensor S1 as trigger, acquiring the information about the sheet from the control section 121 of the image forming apparatus A through the sheet post-processing apparatus B (Step ST02).

If the sheet information acquired from the control section 121 of the image forming apparatus A contains the instruction of performing the selection of the folding mode or the instruction of performing the sheet-folding process (Y in Step ST03), the operation proceeds to Steps ST04 to ST06, performing the sheet folding process. Alternatively, the sheet information acquired may not contain the instruction of performing the selection of the folding mode or the instruction of performing the sheet-folding process or may contain the instruction of not performing the sheet-folding process. If this is the case, the process goes to Step ST07, and no sheet folding is performed.

In Step ST07 (performing sheet non-folding), the pushing plate 35 is positioned in the guiding position (indicated by broken lines 35'), and the registering-roller pair 33 and the folding-roller pair 34 are rotated. Therefore, the sheet transported from the image forming apparatus A passes through the transport path 32 without being folded and transported to the sheet post-processing apparatus B.

The sheet-folding process in Steps ST04 to ST06 is performed in three steps, i.e., the registering process (Step ST04) performed by the registering-roller pair 33, the loop forming process (Step ST05) performed by the folding-roller pair 34, and the folding-line forming process (Step ST06) performed by the pushing plate 35 and folding-roller pair 34. In the registering process, the sheet transported into the sheet folding apparatus C is registered at its front edge, eliminating the sheet skew (sheet inclination). In the loop forming step, the front edge of the sheet is looped in order to make a folding line. In the folding-line forming step, the folding-roller pair 34 forms a folding line on the looped sheet.

The processes performed in Steps ST04 to ST06 will be described below in greater detail with reference to FIGS. 9 to 15. FIGS. 9A to 9F illustrate the sheet-folding steps which the sheet folding apparatus C performs in sequence after it receives the sheet from the image forming apparatus A.

[Registering Process]

FIG. 9A illustrates a sheet having its front edge aligned in the registering process performed in the sheet folding apparatus C. The registering process is executed in accordance with, for example, the process sequence shown in the flowchart of FIG. 10.

The control section 120 is turned on when the first detection sensor S1 detects the front edge of the sheet transported into the sheet inlet path 41 while the rotation of the registering-roller pair 33 is being stopped (Y in Step ST10), and, in response, a folding loop counter (not shown) starts measuring time (Step ST11). When a prescribed time elapses (Y in Step ST12) after the start of the measurement, the control section 120 drives the transport motor MT1 (Step ST13), rotating the registering-roller pair 33 (Step ST13).

The prescribed time in Step ST12 is a time length required to form, in the sheet inlet path 41, a loop necessary or large enough to align the front part of the sheet when the front edge of the sheet abuts on the nip part 38 of the registering roller pair 33. For example, this time can be predetermined based on a test result or the like and preset in the control section 120.

As the registering-roller pair 33 is driven, the sheet is transported to the folding-roller pair 34 through the transport path 32 as is illustrated in FIG. 9B. At this time, the pushing plate 35 exists at the guiding position 35'. The sheet is therefore guided in the path 42 to the upper surface of the pushing plate 35 and is transported straight to the nip part 39 of the folding-roller pair 34. After its front edge passes the protrusion 47 provided at the path 42, the sheet is pushed by the protrusion 47 downward, forming a loop in U-shape in the loop-forming space 50, namely in the region which opposes the large space 48 and in which the inclining part 45*c* and the second horizontal part 45*b* of the upper transport guide 45 are connected in the sheet transporting direction.

[Loop Forming Process]

Figure 11:
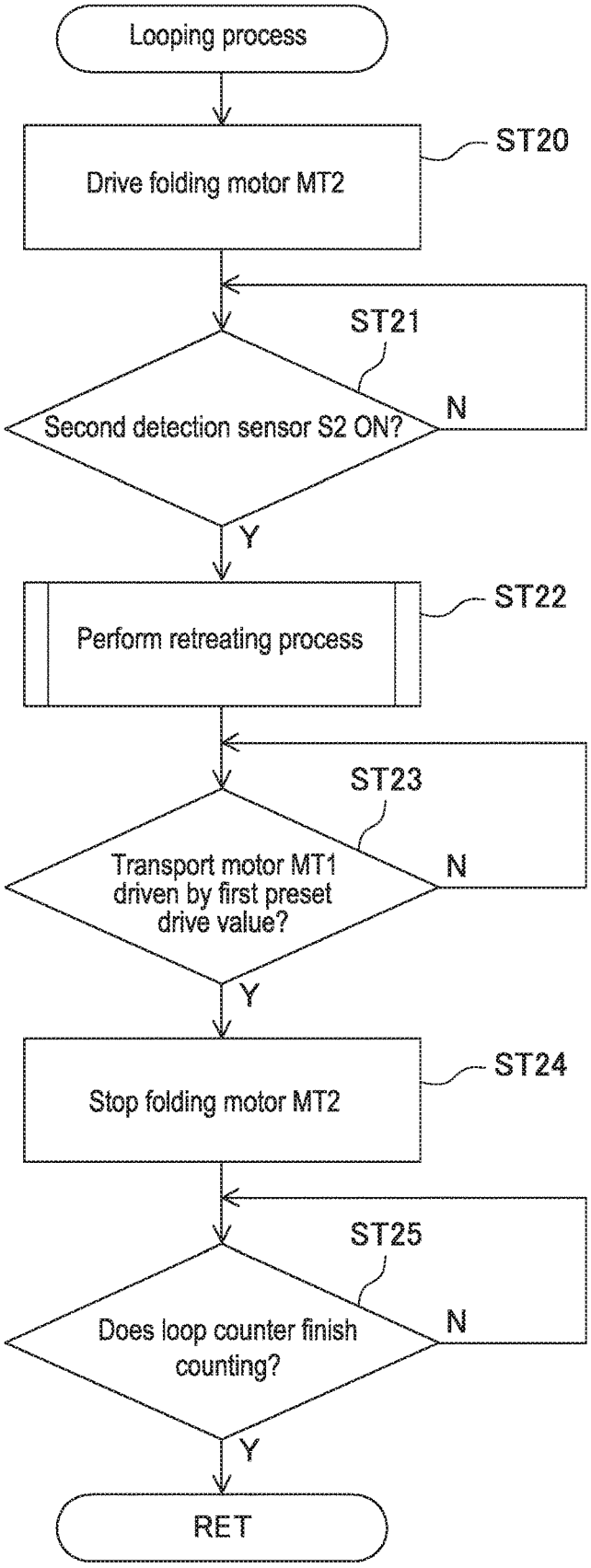
FIG. 11 is a flowchart explaining the loop forming step performed in the sheet folding apparatus.

The loop forming process is performed in, for example, the sequence illustrated in the flowchart of FIG. 11. When the transport motor MT1 is driven, rotating the registering-roller pair in Step ST13, the control section 120 drives the folding motor MT2, rotating the folding-roller pair 34 (Step ST20). As shown in FIG. 9B, the second detection sensor S2 detects the front edge of the sheet being transported, at a position immediately upstream the folding-roller pair 34, and is thereby turned on (Y in Step ST21). Then, the control section 120 performs a process of moving the pushing plate 35 from the guiding position 35' to the retreat position (Step ST22).

Figure 12:
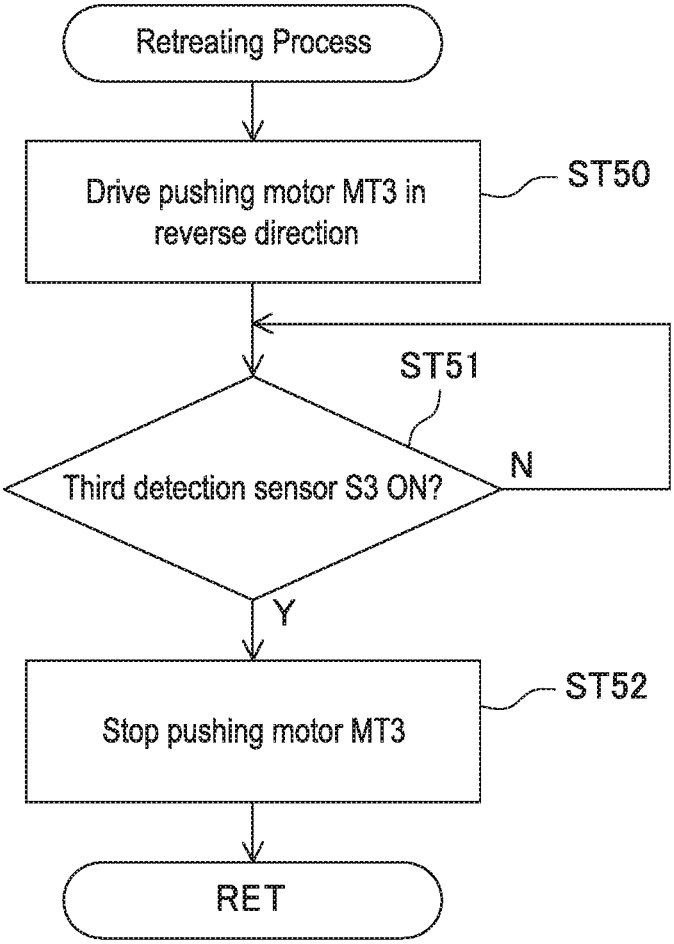
FIG. 12 is a flowchart explaining how a pushing plate moves to the retreat position.

The process of retreating the pushing plate 35 is performed in, for example, the sequence shown in the flowchart of FIG. 12. The control section 120 drives the pushing motor MT3 in the reverse direction (Step ST50), moving the pushing plate 35 upstream in the sheet transporting direction from the guiding position 35' toward the retreat position. In this embodiment, the pushing plate 35 has a detection flag (not shown) at its end upstream as viewed in the sheet transporting direction.

When the third detection sensor S3 arranged below the first lower guide part 46*a* detects the detection flag of the pushing plate 35 and is turned on (Y in Step ST51), the pushing motor MT3 is stopped (Step ST52). The pushing plate 35 is thereby moved to the retreat position shown in FIG. 9C, and the space 48 between the first and second lower guide parts 46*a* and 46*b* is fully opened. As a result, the second passage part of the path 42 is opened to the loop-forming space 50 located below.

Next, the control section 120 starts driving the transport motor MT1 when the second detection sensor S2 detects the front edge of the sheet in Step ST21, and keeps driving the transport motor MT1 until the motor MT1 is driven by a first preset drive value (Y in Step ST23). Then, the control section 120 stops the folding motor MT2 (Step ST24). The first preset drive value is equivalent to the value by which the transport motor MT1 should be driven to move the sheet to the position where the front edge of the sheet is nipped at the nip part 39 of the folding-roller pair 34.

As shown in FIG. 9C, the sheet is therefore held, with its front edge nipped at the nip part 39 of the folding-roller pair 34. Thereafter, the transport motor MT1 is kept driven. The registering-roller pair 33 therefore keeps rotating, transporting the sheet further. As a result, that part of the sheet, which is upstream of the folding-roller pair 34, hangs down into the loop-forming space 50 through the space 48, forming a loop FL. The loop FL will be processed to make a folding line. Thereafter, the loop FL grows as the registering-roller pair 33 transports the sheet. The sheet nipped, at its front edge, by the registering-roller pair 33, bulges into the loop-forming space 50, as described above, before the pushing plate 35 is retreated. Hence, substantially regardless of the stiffness of the sheet, the sheet is smoothly and stably bent, forming a loop in the loop-forming space 50, without excessively increasing the load on the transport motor MT1.

In this embodiment, the distance (i.e., transport distance) the sheet is transported until the front edge of the sheet moves from the position where it is detected by the second detection sensor S2 to the position 10 mm ahead the nip part 39 of the folding-roller pair 34 is converted into the drive value of the transport motor MT1, which corresponds to the distance, and this value is used as the first preset drive value mentioned above. The drive amount of the transport motor MT1 can be the rotation value of the motor (i.e., the number of rotations, rotation angle or rotation time of the rotor shaft) or the distance the sheet is transported by the registering-roller pair 33, namely the rotation value of the driving roller 33*a* (i.e., the number of rotations, rotation angle or rotation time of the roller shaft 61).

In the sheet folding apparatus C, the part of the foldable sheet, at which the sheet will be folded and which is identified from, for example, the distance from the front edge of the sheet in the sheet transporting direction is predetermined from the size and orientation (lengthwise or widthwise) of the sheet. The prescribed count value equivalent to said part of the sheet is preset in the folding loop counter. After the folding motor MT2 is stopped in Step ST24, the count value of the folding loop counter that starts operating in Step ST11 is increased to the prescribed count value (Y in Step ST25). Then, the operation goes to the next folding-line forming process (i.e., Step ST06).

[Folding-Line Forming Process]

Figure 13:
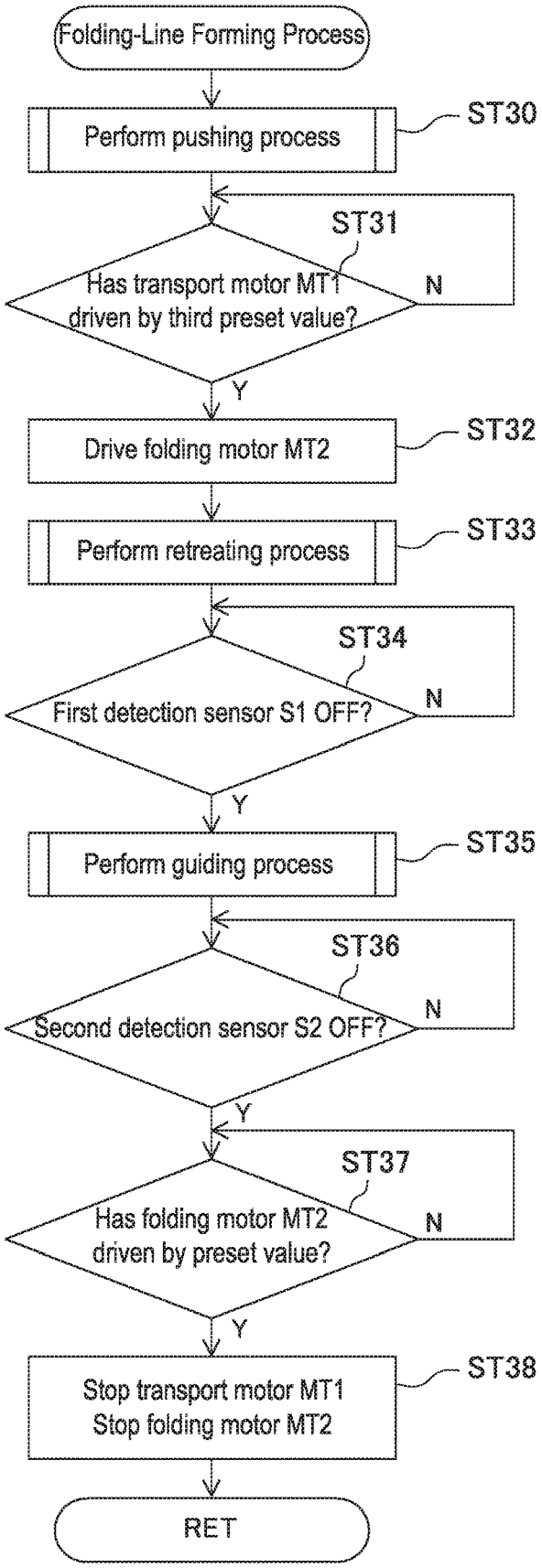
FIG. 13 is a flowchart explaining how the sheet folding apparatus folds a sheet.

The folding-line forming process is performed, for example, in the sequence shown in the flowchart of FIG. 13. The control section 120 starts the process of moving the pushing plate 35 when the folding loop counter finishes counting in Step ST25. The registering-roller pair 33 keeps transporting the sheet, forming a loop FL in the loop-forming space 50 as shown in FIG. 9D. The loop FL has a size desirable to make a folding line at the prescribed part of the sheet.

Figure 14:
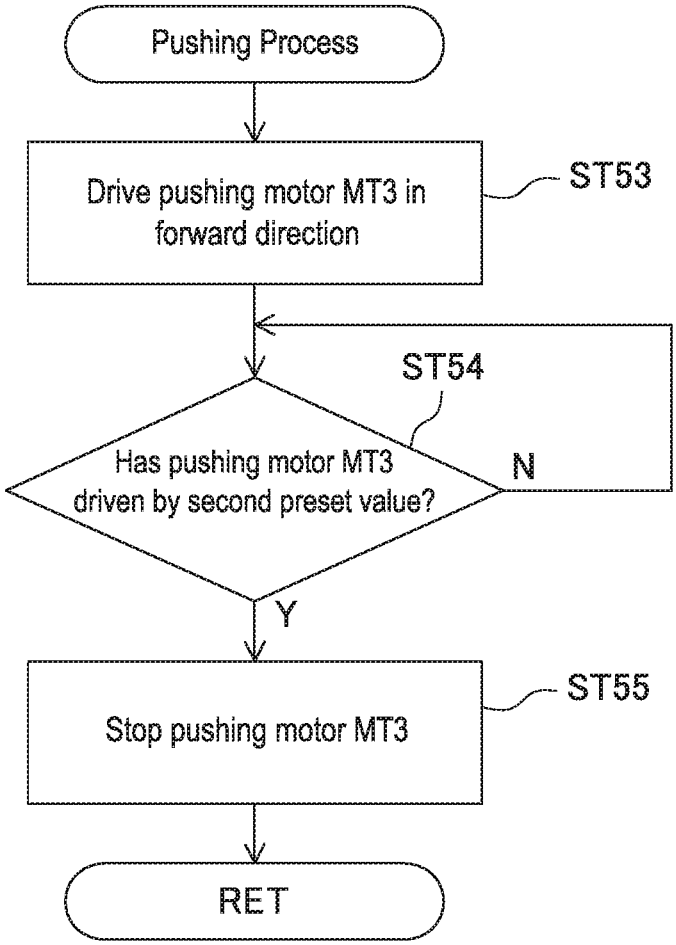
FIG. 14 is a flowchart explaining how the pushing plate is moved to a pushing position.

The pushing process is performed in, for example, the sequence shown in the flowchart of FIG. 14. First, the control section 120 drives the pushing motor MT3 in forward direction (Step ST53), moving the pushing plate 35 in horizontal direction toward the folding-roller pair 34. The pushing plate 35 moves toward the nip part 39 of the folding-roller pair 34, while its front edge is pushing that part of the loop FL which will form a folding line which is the second line as seen from the front edge of the sheet. While the pushing plate 35 is moving, the control section 120 controls the pushing motor MT3, moving the pushing plate 35 at the same speed as the sheet is transported by the registering-roller pair 33 so that the loop FL pushed by the front edge of the pushing plate 35 may not change in position.

The sheet, pushed by the pushing plate 35, moving downstream through the third passage part of the path 42 is restricted, at its upper part (bent upward over the pushing plate 35), from above, by the second horizontal part 45*b* of the upper transport guide 45, while its lower part (bent downward with respect to the pushing plate 35) is restricted from below by the second horizontal guide part 52*a* of the second lower guide part 46*b*, in a state that its leading end part upstream from the nip part 39 of the folding roller pair 34 is held between the second horizontal part 45*b* and the second horizontal guide part 52*a*. The sheet can therefore be bent at the folding position pushed by the pushing plate 35, at which the sheet will be folded to form the second folding line 203 (in FIG. 7), without slipping in the sheet transporting direction between the front edge of the pushing plate 35 and the passage of the sheet moving downstream in the third passage part.

When the driven value of the pushing motor MT3 reaches a second preset value (Y in Step ST54), the control section 120 stops the pushing motor MT3 (Step ST55), whereby the front edge of the pushing plate 35 enters, as is shown in FIG. 9E, between the second horizontal part 45*b* of the upper transport guide 45 and the second horizontal guide part 52*a* of the second lower guide part 46*b* in the third passage, and stops at the pushing position 35". Therefore, that part FP 2 of the sheet, at which the sheet will be folded to form the second folding line, is bent as described above and is transported to a position immediately before the nip part 39 of the folding-roller pair 34.

As described above, by making the pushing plate 35 advance to a gap between the upper transport guide 45 and the second lower guide part 46*b*, the sheet is provisionally folded by being forcedly bent, at the folding position, one upon the other in the vertical direction. After the provisional folding, the sheet is nipped by the folding roller pair 34 at the folding position. This prevents the sheet from opening along the second folding line and hence can provide a neatly folded sheet.

The second preset value is the drive value that enables the pushing motor M3 to move the pushing plate 35 to the pushing position 35" from the retreated position. The drive value of the pushing motor MT3 can be the rotation value of the motor (i.e., the number of rotations, rotation angle or rotation time of the rotor shaft).

After the pushing motor MT3 is stopped in Step ST58, the transport motor MT1 is driven by a third preset value (Y in Step ST31). Then, the control section 120 drives the folding motor MT2 (Step ST32). The third preset value is the drive value by which the transport motor MT1 is driven to rotate the registering-roller pair 33, thereby to transport the sheet continuously even after the pushing motor MT3 is stopped in Step ST58, until the part FP 2 of the sheet is taken into the nip part 39 of the folding-roller pair 34.

When the folding-roller pair 34 is driven by the folding motor MT2, that part of the sheet, at which the second folding line will be made, is taken into the nip part 39 of the folding-roller pair 34 as shown in FIG. 9F. While being transported downstream, the sheet is pressed and bent between the upper folding roller 34*a* and the lower folding roller 34*b*. As the sheet is so pressed and bent, the second folding line F2 (203) is made at a preset part. As described above, the bent part FP2 of the sheet is transported, without slipping or changing in position in the sheet transporting direction, and is taken into the nip part 39 of the folding-roller pair 34. The second folding line F2 is positioned at high precision, unlike in the conventional apparatuses.

After driving the folding motor MT2 in Step ST32, the control section 120 performs a plate-retreating process, moving the pushing plate 35 from the pushing position 35" back to the above-mentioned retreat position, not to prevent the sheet from being taken into the nip part 39 of the folding-roller pair 34 (Step ST33). The plate-retreating process is performed in the same way as in loop-forming process explained with reference to FIG. 12 and FIGS. 9B and 9C.

That is, in the state of FIG. 9E, the control section 120 drives the pushing motor MT3 in reverse direction, moving the pushing plate 35, in the horizontal direction, from the pushing position 35" toward the above-mentioned retreat position, upstream in the sheet transporting direction. When the third detection sensor S3 arranged below the first lower guide part 46*a* detects the detection flag of the pushing plate 35, and is therefore turned on, the pushing motor MT3 is stopped. The pushing plate 35 is thereby arranged at the retreat position as shown in FIG. 9F.

At this time, the space 48 between the first lower guide part 46*a* and the second lower guide part 46*b* is fully opened and the second passage part of the path 42 is connected to the loop-forming space 50 located below. The loop FL can therefore be continuously and smoothly taken into the nip part 39 of the folding-roller pair 34 from the nipping start as illustrated in FIG. 9E, not interfering with the pushing plate 35.

Even after the pushing plate 35 is moved to the retreat position, the folding-roller pair 34 is kept driven. Therefore, as shown in FIG. 9F, the sheet is nipped by the folding-roller pair 34, first at its front edge and then at two folding lines (namely, Z-folding lines) made by the folding-roller pair 34. The sheet is then transported downstream through the sheet outlet path 43.

As the sheet is so transported, the loop FL gradually becomes smaller in the loop-forming space 50. The loop FL then enters the third passage part of the path 42, and is squeezed, from above and below, by the first horizontal part 45*a* of the upper transport guide 45 and the second inclining guide part 52*b* of the second lower guide part 46*b*. The loop therefore becomes a thin loop extending in the sheet transporting direction. The loop FL further moves into the gap between the second horizontal part 45*b* and the second horizontal guide part 52*a* of the second lower guide part 46*b*, and is folded double, from above and below, at a part FP1 at the rear edge (upstream edge) of the sheet, where a first folding line will be made.

The sheet having the folded part FP1, so bent as described above, is transported without slipping or changes in position, with respect to the upstream part of the sheet overlapped on it. The sheet is then pressed and bent at the nip part 39 of the folding-roller pair 34. The sheet can therefore have a first folding line (line 202 shown in FIG. 7) made at the desired position, with high reliability and high precision.

A Z-folded sheet SH is thereby obtained, which has an inner folding line 202 and an outer folding line 203 as illustrated in FIG. 7. In this embodiment, the folding-roller pair 34 not rotating forms a loop FL while they are nipping the front edge of the sheet, and the folding-roller pair 34 are then rotated, making the first and second folding lines. Hence, the front part of the sheet, nipped while forming a folding loop FL, is Z-folded while it is bulging from the second folding line toward the front edge (to downstream edge) of the sheet.

Next, in the sheet inlet path 41, the first detection sensor S1 detects the rear edge of the sheet being transported by the registering-roller pair 33 and the folding-roller pair 34, and is turned off (Y in Step ST34). Then, the control section 120 performs a guiding process, moving the pushing plate 35 from the retreat position to the guiding position 35' (Step ST35). At this time, the folding loop FL has already passed from the folding-roller pair 34. Therefore, even if the pushing plate 35 is moved to the guiding position 35', no troubles will be made in the process of transporting the sheet through the path 42 or in the process of forming a folding line by using the folding-roller pair 34.

Figure 15:
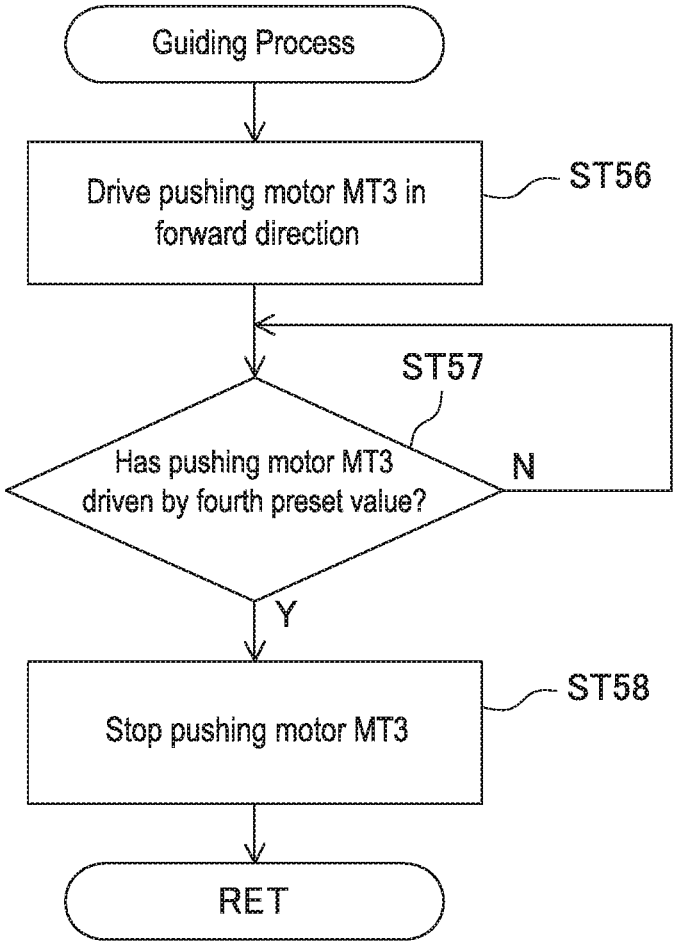
FIG. 15 is a flowchart explaining how the pushing plate is moved to a guiding position.

The above-mentioned guiding process is performed in the sequence shown in, for example, the flowchart of FIG. 15. First, the pushing motor MT3 is driven in the forward direction (Step ST56), moving the pushing plate 35 in horizontal direction toward the folding-roller pair 34. If the pushing motor MT3 is driven by the fourth preset value (Y in Step S57), the pushing motor MT3 is stopped (Step ST58).

The fourth preset value is the drive value of the pushing motor MT3, which is required to move the pushing plate 35 from the retreat position to the guiding position 35'. The pushing plate 35 therefore closes the space 48 between the first and second lower guide parts 46*a* and 46*b*. Then, the rear edge of the sheet is guided through the path 42 onto the upper surface of the pushing plate 35, and the sheet is transported straight toward the folding-roller pair 34. The rotation value of the pushing motor MT3 (i.e., number of rotations, angle of rotation or rotation time of the rotary shaft) can be used as the drive value of the pushing motor MT3.

Next, the second detection sensor S2 may detect the rear edge (i.e., upstream edge) of the sheet passing through the path 42, and may be turned off (Y in Step ST36). At this time, the control section 120 starts measuring the drive value of the folding motor MT2. When the drive value of the motor MT2 reaches a preset motor-stopping value (Y in Step ST37), the transport motor MT1 and the folding motor MT2 are stopped (Step ST38).

The motor-stopping value mentioned above is a drive value of the folding motor MT2, which is large enough to allow the rear edge of the sheet to pass through the nip of the folding-roller pair 34. The registering-roller pair 33 and the folding-roller pair 34 can therefore be stopped without making any trouble in transporting the sheet through the sheet-outlet port 32*b* to the sheet post-processing apparatus B, terminating the process of Z-folding the sheet.

According to another embodiment of the present invention, the sheet can be transported straight to the inclined part (second passage) 45*c* of the path 42 from the registering-roller pair 33. Also, the inclined part (second passage) 45*c* of the path 42 can be a curved passage. Further, the inclined part (second passage) 45*c* and the second horizontal part 45*b*, of the path 42 can be configured by a continuous curved passage.

FIGS. 16A to 16D are schematic diagrams showing modifications of the path 42 according to the above-described embodiment. A path 70 shown in FIG. 16A to 16D, modified from the path 42, has a downstream passage 70*b* extending along the tangential line from the nip part 39 of the folding-roller pair 34, and an upstream passage 70*a* connected, substantially at a constant inclination angle from an upper position, with the upstream side of the downstream passage 70*b*. The upstream passage 70*a* shown in FIGS. 16A to 16D extends toward the loop-forming space 50 formed below the downstream passage 70*b*. The part connecting the upstream passage 70*a* and the downstream passage 70*b* has a relatively large obtuse angle, forming a protrusion 71.

Figure 16A:
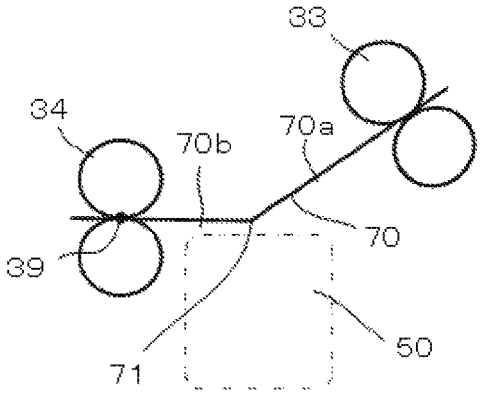
FIG. 16A to FIG. 16D are schematic diagrams illustrating modifications of the path.
Figure 16B:
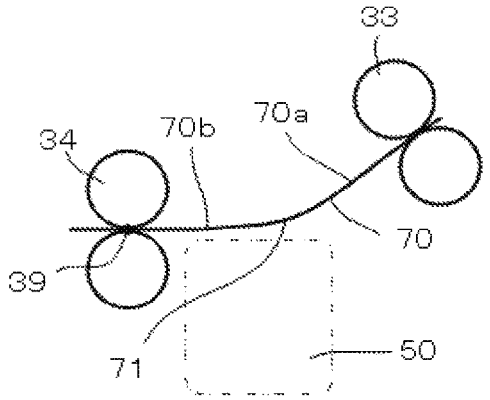
Figure 16C:
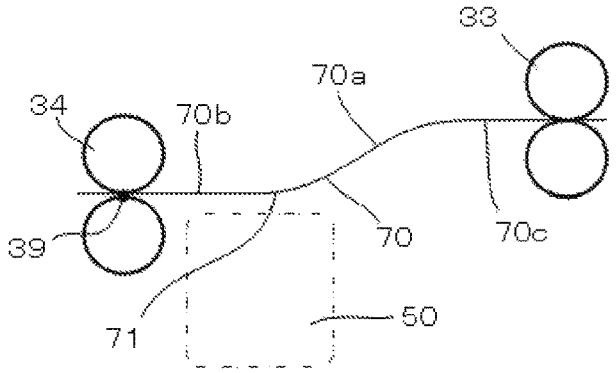
Figure 16D:
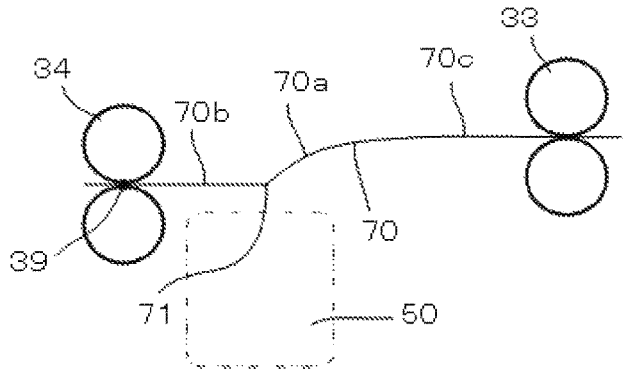

FIG. 16A shows a configuration in which the sheet is transported from the registering-roller 33 straight to the upstream passage 70*a*. FIG. 16B shows a curved upstream passage 70*a*. FIGS. 16C and 16D respectively show a curved upstream passage 70*a* and a linear downstream passage 70*b*. FIG. 16C shows an upstream passage 70*a*, which bulges out downward, while FIG. 16D shows an upstream passage 70*a*, which bulges out upward. In FIGS. 16C and 16D, a passage 70*c* is formed between the registering-roller pair 33 and the upper passage 70*a*. This passage 70*c* corresponds to the first horizontal part (third passage) 45*a* according to the above embodiment.

The modification shown in FIG. 16 is substantially the same as the embodiment previously described, except for the configuration of path 42, and the explanation thereof is therefore omitted.

The preferred embodiments of this invention has been described above. However, the invention is not limited to the embodiments. Needless to say, the invention can be reduced to practice, by changing or modification, within its technical scope.

This application is based upon and claims the benefit of priority from Japanese Patent Application No. 2018-230528, filed Dec. 10, 2018, the entire contents of which are incorporated herein by reference.

What is claimed is:

1. A sheet folding apparatus for folding sheets, comprising:

a feeding-roller pair configured to form a sheet loop;

a loop-forming space provided downstream from the feeding-roller pair, for receiving the sheet loop formed by the feeding-roller pair;

a pushing member configured to push the sheet looped in the loop-forming space;

a folding-roller pair configured to nip a predetermined part of the sheet pushed by the pushing member and fold the sheet; and a path provided between the feeding-roller pair and the folding-roller pair, for guiding the sheet fed from the feeding-roller pair toward the loop-forming space, wherein the path is arranged above a tangential line passing a nip point of the folding-roller pair that nips the sheet, and the loop-forming space is arranged below the tangential line passing the nip point of the folding-roller pair.

2. The sheet folding apparatus according to claim 1, wherein the path forms at least a part of a passage extending from the feeding-roller pair to the folding-roller pair.

3. The sheet folding apparatus according to claim 1, wherein the pushing member is arranged in a space between the path and the loop-forming space, and is moved toward the tangential line of the nip point of the folding-roller pair.

4. A sheet folding apparatus for folding sheets, comprising:

a feeding-roller pair configured to transport a sheet;

a folding-roller pair configured to nip a predetermined part of the sheet and fold the sheet;

a transport path configured to guide the sheet transported from the feeding-roller pair to the folding-roller pair;

a loop-forming space for forming a sheet loop between the feeding-roller pair and the folding-roller pair; and a pushing member configured to push the looped sheet, allowing the folding-roller pair to nip a prescribed part of the sheet, wherein the transport path is composed of a first passage for guiding the sheet to the folding-roller pair, a second passage provided upstream from the first passage, for guiding the sheet transported from the feeding-roller pair toward the loop-forming space arranged below the first passage, and a third passage for guiding the sheet to the second passage, and the first and third passages are arranged horizontally, while the second passage inclines from the third passage toward the first passage.

5. The sheet folding apparatus according to claim 4, further comprising a drive mechanism configured to move the pushing member to a retreat position below the second passage and to an operative position where a prescribed part of the sheet is nipped by the folding-roller pair.

6. The sheet folding apparatus according to claim 5, wherein the drive mechanism causes the pushing member to move from the retreat position below the second passage, via the loop-forming space provided below the first passage, to the operative position.

7. The sheet folding apparatus according to claim 4, wherein the second passage is connected to the first passage at an upstream side of the first passage; and the loop-forming space includes an opening at a part connecting the first passage and the second passage in the transport path, for receiving the sheet loop.

8. A sheet folding apparatus for folding sheets, comprising:

a feeding-roller pair configured to transport sheets;

a folding-roller pair arranged downstream from the feeding-roller pair, for nipping a prescribed part of the sheet and fold the sheet;

a transport path having a first passage for guiding the sheet to the folding-roller pair, and a second passage inclined downward, for guiding the sheet from the feeding-roller pair to the first passage;

a loop-forming space provided below the first passage, for receiving a sheet loop between the feeding-roller pair and the folding-roller pair;

a pushing member arranged at a location below the second passage and in the neighborhood of the first passage, for pushing the sheet to move to a position where the folding-roller pair nips a prescribed part of the sheet; and a control section configured to control the feeding-roller pair, folding-roller pair and pushing member, the control section including controlling the feeding-roller pair and folding-roller pair so as to form a sheet loop, and then moving the pushing member so that a prescribed part of the sheet is nipped by the folding-roller pair.

9. The sheet folding apparatus according to claim 8, wherein the pushing member has a drive mechanism that moves to a sheet transporting direction.

10. The sheet folding apparatus according to claim 8, wherein the transport path includes a third passage arranged upstream from the second passage and connected to the second passage; and the first and third passages are horizontally arranged, while the second passage inclines downward from the third passage toward the first passage.

11. The sheet folding apparatus according to claim 10, wherein the transport path has an opening for sending the sheet transported from the feeding-roller pair into the loop-forming space; and the drive mechanism drives the pushing member to move to a retreat position to open the opening of the transport path, a pushing position to cause the folding-roller pair to nip a prescribed part of the sheet, and a guiding position to guide the sheet being transported through the transport path by closing the opening of the transport path.

12. The sheet folding apparatus according to claim 11, wherein a connection part connecting the first passage and the second passage is provided substantially at a center, in a sheet transporting direction, of the opening opened and closed due to the movement of the pushing member.

13. An image forming apparatus comprising:

an image forming unit configured to form an image on a sheet; and a sheet folding apparatus according to claim 8, which is configured to fold a sheet transported from the image forming unit.

* * * * *